US011767141B1

(12) United States Patent
Cannavan

(10) Patent No.: US 11,767,141 B1
(45) Date of Patent: Sep. 26, 2023

(54) SYSTEM AND METHOD FOR MAKING CORRUGATED PACKAGING THAT ENCLOSES CURVED OBJECTS

(71) Applicant: Peachtree Packaging, Inc., Lawrenceville, GA (US)

(72) Inventor: John Anton Cannavan, Winder, GA (US)

(73) Assignee: Peachtree Packaging, Inc., Lawrenceville, GA (US)

( * ) Notice: Subject to any disclaimer, the term of this patent is extended or adjusted under 35 U.S.C. 154(b) by 143 days.

(21) Appl. No.: 17/377,099

(22) Filed: Jul. 15, 2021

Related U.S. Application Data

(60) Provisional application No. 63/026,552, filed on May 18, 2020.

(51) Int. Cl.

| | |
|---|---|
| ***B65D 5/32*** | (2006.01) |
| ***B65D 5/02*** | (2006.01) |
| ***B65D 85/00*** | (2006.01) |
| *B65D 5/00* | (2006.01) |

(52) U.S. Cl.
CPC ..... *B65D 5/0209* (2013.01); *B65D 5/0254* (2013.01); *B65D 5/327* (2013.01); *B65D 85/54* (2013.01); *B65D 5/009* (2013.01); *B65D 2585/6887* (2013.01)

(58) Field of Classification Search
CPC ..... B65D 5/32; B65D 5/326–327; B65D 5/0085; B65D 5/009; B65D 5/427; B65D 85/54; B65D 2585/6887; B65D 2585/6882
USPC ..... 229/111–112, 122.21; 206/448
See application file for complete search history.

(56) References Cited

U.S. PATENT DOCUMENTS

| | | | | |
|---|---|---|---|---|
| 2,984,343 | A * | 5/1961 | Van | B65D 5/5064 206/448 |
| 9,592,926 | B2 * | 3/2017 | Dammeyer | B65D 5/2052 |
| 9,611,072 | B2 * | 4/2017 | Sharon | B65D 21/0212 |
| 10,692,404 | B2 * | 6/2020 | Ho | G09F 7/18 |
| 2016/0068296 | A1 * | 3/2016 | Dammeyer | B65D 5/2052 206/335 |
| 2019/0051221 | A1 * | 2/2019 | Ho | B65D 5/00 |

FOREIGN PATENT DOCUMENTS

| | | | |
|---|---|---|---|
| CN | 208931868 U | * | 6/2019 |
| CN | 212829633 U | * | 3/2021 |
| CN | 212829634 U | * | 3/2021 |

(Continued)

*Primary Examiner* — Nathan J Newhouse
*Assistant Examiner* — Phillip D Schmidt
(74) *Attorney, Agent, or Firm* — Smith Tempel Blaha LLC; Matthew T. Hoots

(57) ABSTRACT

A system for enclosing curved objects includes a first panel may include a first top portion, a first rear portion, a first side portion, a first bottom portion, and a first front portion. A second panel includes a second top portion, a second rear portion, a second bottom portion, and a second front portion. And a third panel includes a third top portion, a third rear portion, a second side portion, a third bottom portion, and a third front portion. The first panel is coupled to the second panel by at least a tab and a slot. And the second panel is coupled to the third panel by at least a tab and a slot. Each top portion is coupled to a respective front portion by a tab and a cut-out aperture. Each panel is positioned at an angle relative to a neighboring panel. The angle may comprise an obtuse angle.

8 Claims, 24 Drawing Sheets

(56) References Cited

FOREIGN PATENT DOCUMENTS

| | | | | |
|---|---|---|---|---|
| DE | 102014100779 | A1 * | 7/2015 | ..... B65D 5/009 |
| DE | 202020103697 | U1 * | 9/2020 | ..... B65D 5/00 |
| DE | 202020105071 | U1 * | 1/2021 | ..... B65D 5/00 |
| WO | WO-2019075499 | A1 * | 4/2019 | |

* cited by examiner

SYSTEM AND METHOD FOR MAKING CORRUGATED PACKAGING THAT ENCLOSES CURVED OBJECTS

BACKGROUND

The present invention relates to corrugated packaging solutions and, more particularly, to a system and method for generating a corrugated packaging solution for containing curved objects.

In the past, it has been challenging for manufacturers of curved objects to provide containers for shipping these curved objects because of the geometry for these curved objects. That is, most shipping containers usually have a square or rectilinear geometry. This geometry with straight lines can make it difficult for packaging or enveloping curved objects which are to be shipped.

For example, manufacturers who produce automobile bumpers often face issues in shipping these bumpers since most automobile bumpers have a curved or "C-shape" to their geometry. Automobile bumper manufactures usually must use rectangular boxes which are often too large to accommodate the curved shape or geometry of these bumpers.

Accordingly, what is needed in the art is a packaging solution which may reduce the amount of packaging materials and which may more closely match the geometry of a curved object that is desired to be shipped.

SUMMARY

Exemplary embodiments of a system and method for generating a curved corrugated packaging solution are disclosed. Certain embodiments may be constructed from three interlocking panels constructed of a corrugated material, such as a cardboard, although it is envisioned that embodiments of the solution may be constructed from any material that can be die-cut or otherwise converted into a foldable template(s). Exemplary embodiments of the solution may be referred to as a "boomerang box" and configured for secure packaging and shipping of an automotive bumper.

A system for enclosing curved objects includes a first panel may include a first top portion, a first rear portion, a first side portion, a first bottom portion, and a first front portion. A second panel includes a second top portion, a second rear portion, a second bottom portion, and a second front portion. And a third panel includes a third top portion, a third rear portion, a second side portion, a third bottom portion, and a third front portion.

The first panel is coupled to the second panel by at least a tab and a slot. And the second panel is coupled to the third panel by at least a tab and a slot. Each top portion is coupled to a respective front portion by a tab and a cut-out aperture.

Each panel is positioned at an angle relative to a neighboring panel. The angle may comprise an obtuse angle. Meanwhile, each top portion may be at a ninety degree angle relative to a respective front portion. Similarly, each side portion may be at a ninety degree angle relative to a respective front portion.

Each cut out-aperture may include a flap that is positioned adjacent to a respective tab. Each cut-out aperture may further include an opening. And a curved object may be positioned within a volume defined by the three panels.

The second bottom portion of the second panel may have a trapezoidal shape. The trapezoidal shape of the second bottom portion may comprise a substantially isosceles trapezoidal shape. And each top portion may mirror a shape of its respective bottom portion.

This summary is provided to introduce a selection of concepts that are further described below in the detailed description and illustrated in the several detailed figures. This summary is not intended to identify key or essential features of the claimed subject matter, nor is it intended to be used as an aid in limiting the scope of the claimed subject matter.

BRIEF DESCRIPTION OF THE DRAWINGS

In the figures, similar components and/or features may have the same reference label. Further, various components of the same type may be distinguished by following the reference label with a second label that distinguishes among the similar components. If only the first reference label is used in the specification, the description applies to any one of the similar components having the same first reference label irrespective of the second reference label.

DETAILED DESCRIPTION

Various embodiments, aspects and features of the present invention encompass a system and method for constructing a curved corrugated packaging solution from flat templates, or a flat template (depending on embodiment), of a perforatable and foldable material such as, but not limited to, corrugated cardboard. Advantageously, because embodiments of the solution are constructed from flat components made of corrugated cardboard (or similar material) that has been die-cut, perforated and/or creased according to templates, the components may be inexpensively and efficiently shipped in their flat forms before being folded and integrated together on-site to form a curved corrugated packaging or "boomerang box." Additionally, due to the novel design and construction of embodiments of the solution, a boomerang box according to the solution may be efficiently and quickly folded into its deployed form.

Figure 1:
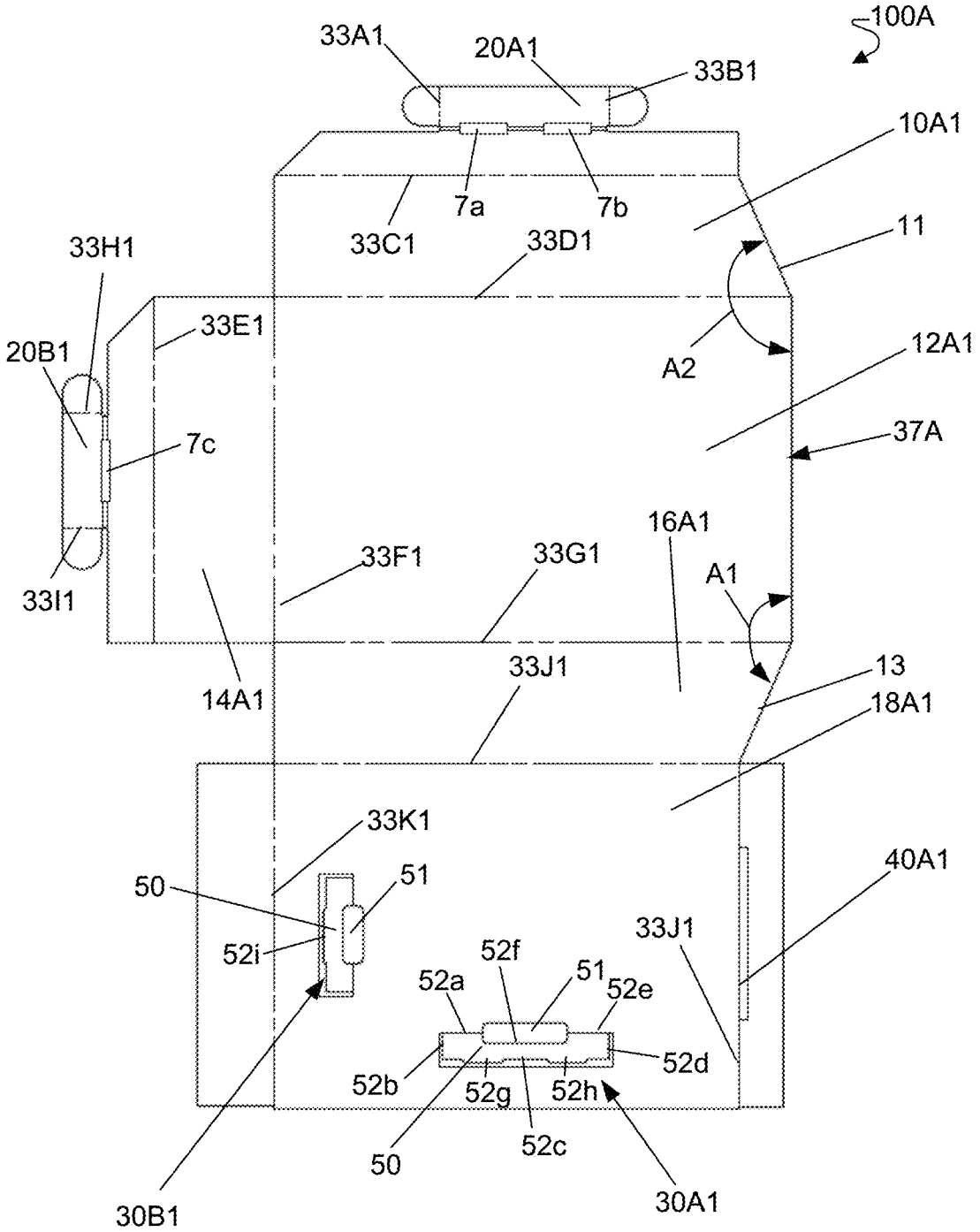
FIG. 1 illustrates a die-cut template for a first panel of three panels that may be applied to a substantially planar material like corrugated cardboard.
Figure 5:
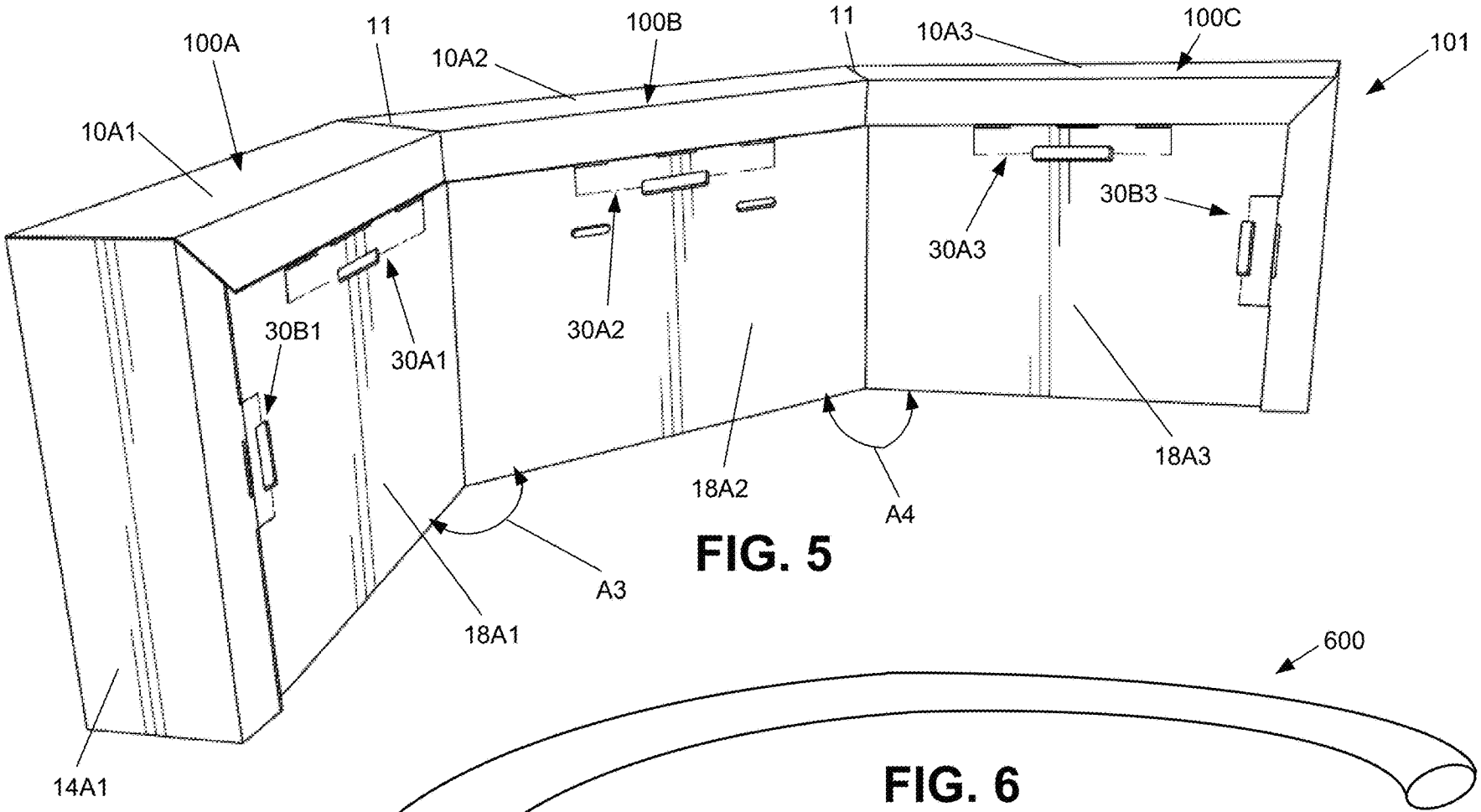
FIG. 5 illustrates a perspective view of the finished system/product formed from the three panels of FIGS. 1-4.

Referring now to FIG. 1, this figure illustrates a die-cut template for a first panel 100A of three panels that may be applied to a substantially planar material like corrugated cardboard. The first panel 100A in FIG. 1 exists in a substantially planar or flat state. This state constitutes an intermediate product or intermediate phase relative to the finished product or finished inventive system 101 that is illustrated in FIG. 5 and described in more detail below. FIG. 1 illustrates how the first panel 100A would be cut along outer edge 37A from a larger plane/portion of corrugated cardboard material.

The first panel 100A may comprise a top portion 10A1, a rear portion 12A1, a side portion 14A, a bottom portion 16A1, and a front portion 18A1. The front portion 18A1 may further comprise a cut-out aperture 30A1. Each cut-out aperture 30A1 has a rectangular opening 51 which is a hole or absence of material. The cut-out aperture 30 has a central flap 50 that is coupled to the front portion 18A1 by two edges 52*a*, 52*e* of the opening 51. Meanwhile, the central flap 50 has sides three sides 52*b*, 52*c*, 52*d* which are disconnected from the front portion 18A1. The central flap 50 further has a portion 52*f* of the opening 51. The central flap 50 may further comprise mini-tabs 52*g*, 52*h*. These mini-tabs 52*g*, 52*h* may mate/be inserted into apertures 7*a*, 7*b* of tab 20A1 when tab 20A1 is inserted into cut-out aperture 30A1 as will be shown in the later views. Each first cut-out aperture 30A may have these mini-tabs 52*g*, 52*h*. And similarly, each first tab 20A may have the two apertures 7*a*, 7*b*.

Each of the larger portions 10A1, 12A1, 14A1, 16A1, and 18A1 may be defined by a combination of the outer edge 37A of the geometry shown in FIG. 1 and the fold lines 33. Fold lines 33 define lines where the panel 100A is folded (as shown in later Figures) to form the three-dimensional volume/package/finished/completed product illustrated in FIG. 5 described in more detail below.

Specifically, and as an example, the top portion 10A1 of first panel 100A may be defined by the edge 37A, a fold line 33D1, and a fold line 33C1. Similarly, the rear portion 12A1 may be defined by edge 37A, a fold line 33G1, a fold line 33F1, and the fold line 33D1. The remaining three portions 14A1, 16A1, and 18A1 of panel 100A are defined similar to the top portion 10A1 and rear portion 12A1 described above and as shown in FIG. 1.

Figure 9:
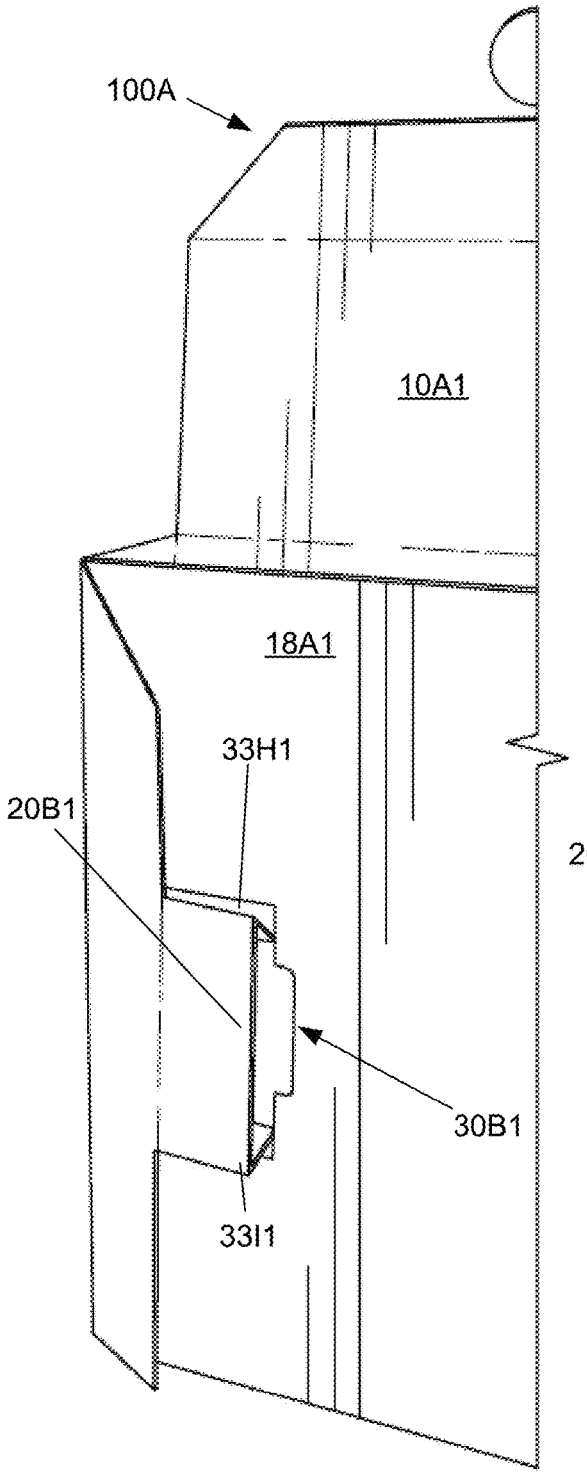
FIG. 9 illustrates how the second tab that is coupled to the side portion of the first panel is mated and pushed through a second aperture of the front portion of the first panel.
Figure 10:
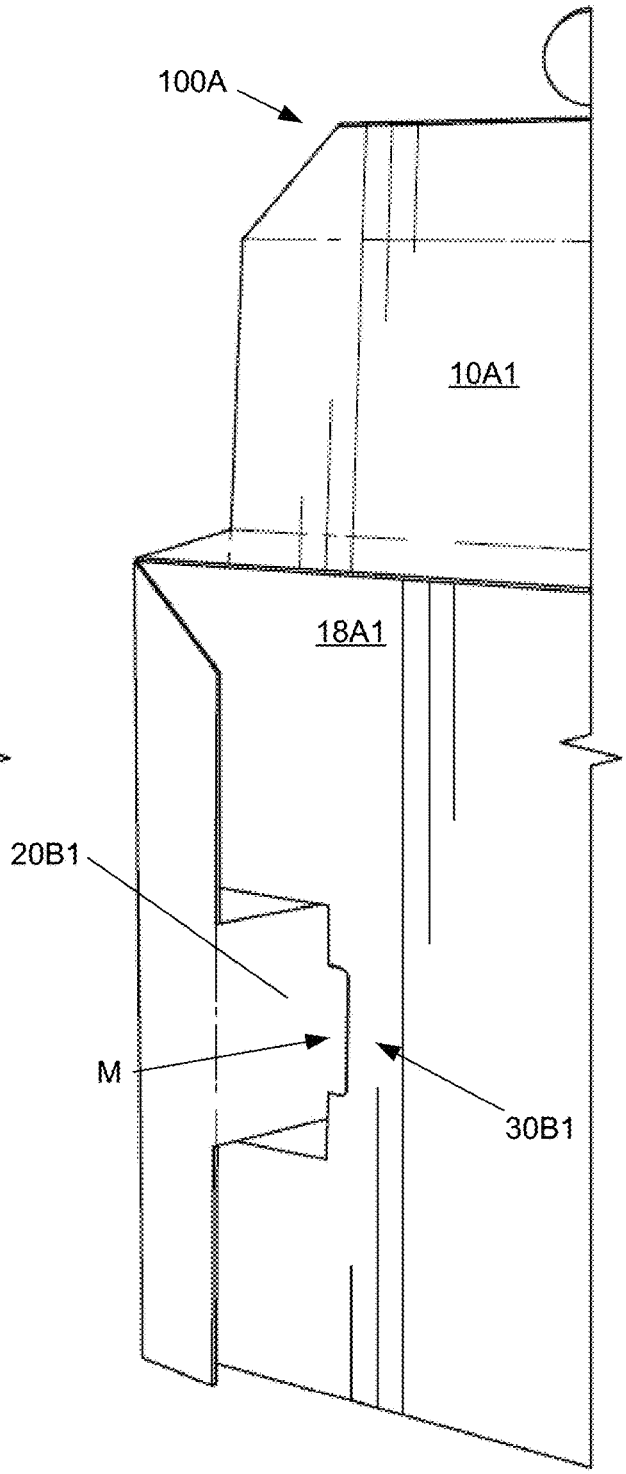
FIG. 10 illustrates how the second tab is continued to be pushed through a second aperture of the front portion of the first panel along movement arrow.
Figure 19:
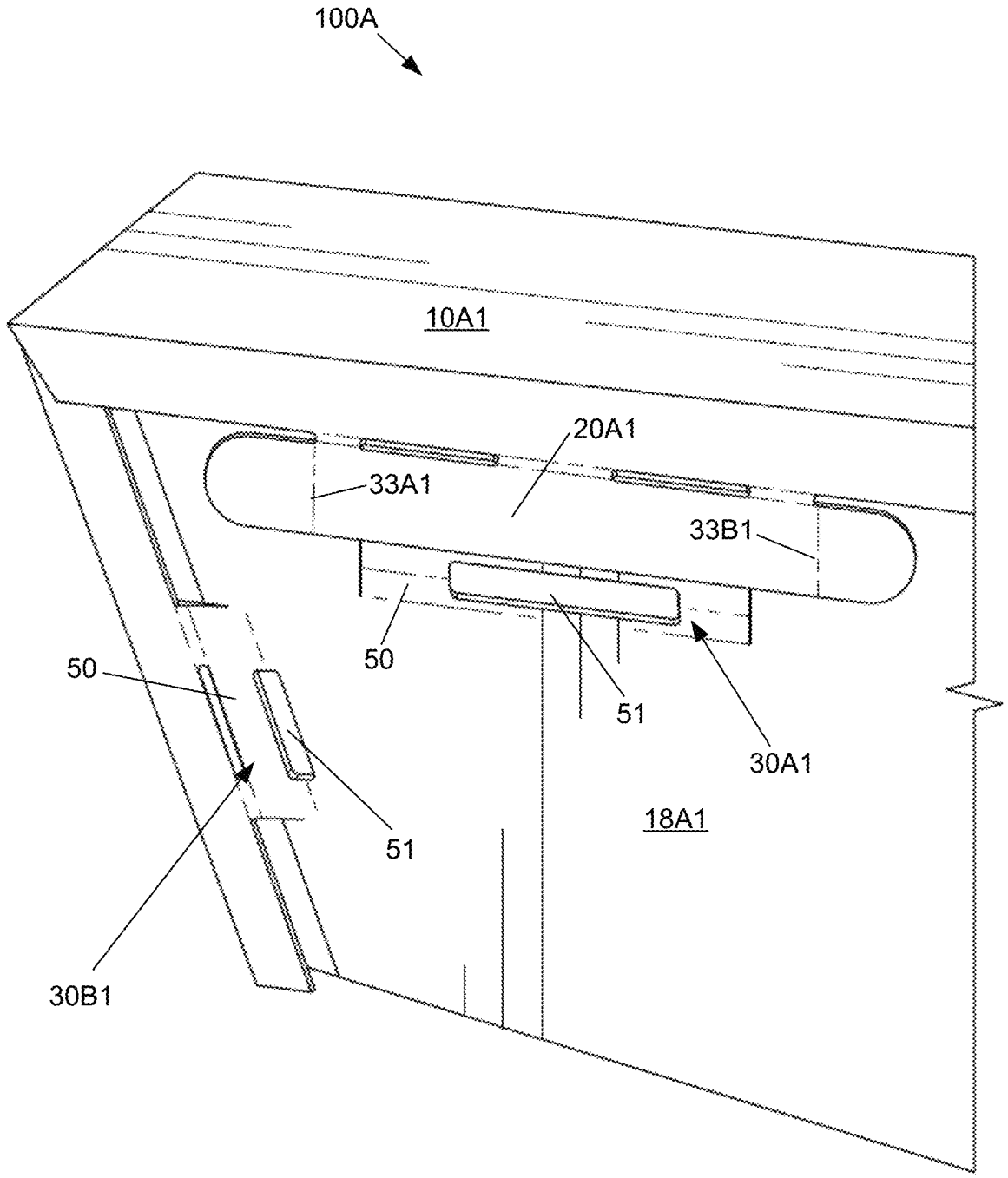
FIG. 19 illustrates a top perspective view of the first panel before the top portion is completely closed upon and completely coupled to the front portion using the cut-out aperture.

The top portion 10A1 may further comprise a first tab 20A1 which has fold lines 33A1, 33B1. The first tab 20A1 is later mated (as shown in FIG. 19) and pushed into a first cut-out aperture 30A1 of the front portion 18A1 as will be shown in FIG. 5 described below. The first tab 20A1 may have apertures 7*a*, 7*b* where it connects to the top portion 10A1. These apertures 7*a*, 7*b* may receive portions of the flap 50 of the cut-out aperture 30A1. Similarly, a second tab 20B1 that is coupled to the side portion 14A1 is later mated (as shown in FIGS. 9-10) and pushed through a second cut-out aperture 30B1, which is also present in the front portion 18A1 as will be shown in FIG. 5 described below. This second tab 20B1 may also have an aperture 7*c* where it connects to the side portion 14A1. This aperture 7*c* may receive a portion of the flap 50 of the second cut-out aperture 30B1. Specifically, this aperture 7*c* may receive a mini-tab 52*i* of the flap 50 of the cut-out aperture 30B1 as will be described below. Each second tab 20B may have this structure comprising the aperture 7*c*. Similarly, each second cut-out aperture 30B may have a corresponding mini-tab 52*i*.

The second tab 20B1, like the first tab 20A1, has fold lines 33H1, and 3311. The fold lines 33H1 and 3311 allow the second tab 20B1 to be folded along these fold lines 33H1, 3311 and to be inserted into the second cut-out aperture 30B1. Similarly, the fold lines 33A1, 33B1 of the first tab 20A1 allow the first tab 20A1 to be folded along these fold lines 33A1, 33B1 and to be inserted into the first cut-out aperture 30A1 of the front portion 18A1. The front portion 18A1 may further comprise a rectangular slot 40A1 which mates with a portion of a second panel 100B (see FIG. 2) as will be described below.

Also illustrated in FIG. 1 are two angles A1, A2. Angle A1 is defined by a side 13 of the bottom portion 16A1 and a side of the rear portion 12A1 of the first panel 100A. Similarly, the second angle A2 is defined by a side 11 of the top portion 10A1 and a side of the rear portion 12A1. These two angles A1, A2 dictate the overall angle or position of the first panel 100A relative to the second panel 100B as illustrated in FIG. 5 described below.

According to the exemplary embodiment illustrated in FIG. 1, the top portion 10A1 and the bottom portion 16A1 may comprise a trapezoidal shape. Specifically, the trapezoidal shape may comprise a right trapezoidal shape. Other shapes for the top portion 10A1 and the bottom portion 16A1 are possible and are included within the scope of this disclosure. It is the trapezoidal shape of the top and bottom portions 10A1, 16A1 that dictate/control the amount of curvature provided by the completed system 101 illustrated in FIG. 5.

Figure 2:
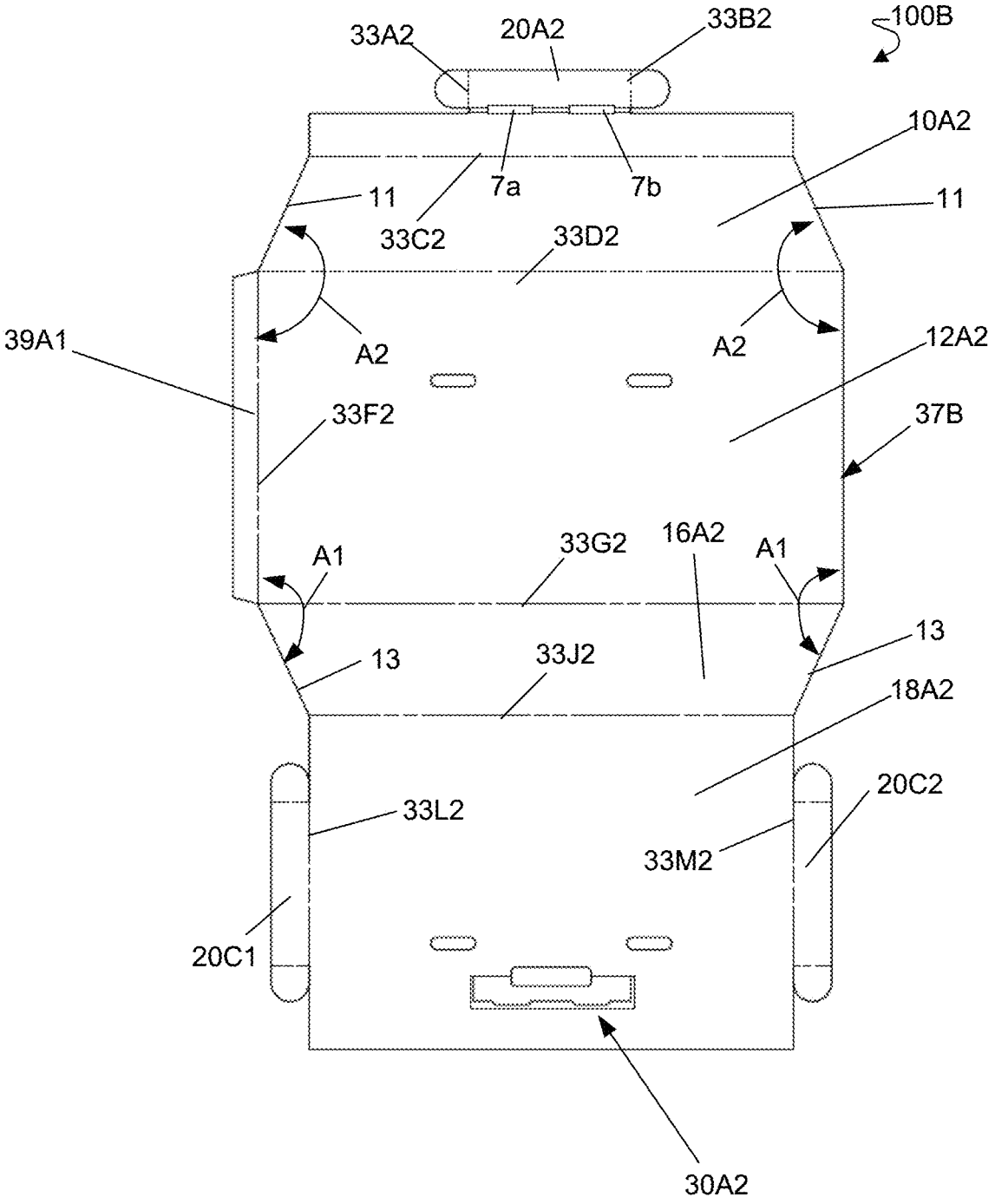
FIG. 2 illustrates a die-cut template for a second panel of three panels that may be applied to a substantially planar material like corrugated cardboard.

Referring now to FIG. 2, this figure illustrates a die-cut template for a second panel 100B of three panels that may be applied to a substantially planar material like corrugated cardboard. The second panel 100B shares similarities with the first panel 100A of FIG. 1, hence the use of similar reference numerals in FIG. 2 compared to FIG. 1.

Similar to the first panel 100A of FIG. 1, the second panel 100B of FIG. 2 may comprise a top portion 10A2, a rear portion 12A2, a bottom portion 16A2, and a front portion 18A2. However, unlike the first panel 100A of FIG. 1, the rear portion 12A2 of the second panel 100B does not have a side portion 14A1 (as illustrated in FIG. 1).

Another difference between the first panel 100A of FIG. 1 and the second panel 100B of FIG. 2 is that the front portion 18A2 of the second panel 100B has only a single cut-out aperture 30A2. Further, unlike the front portion 18A1 of FIG. 1, the front portion 18A2 of FIG. 2 has two tabs 20C1, 20C2. Each tab 20C1, 20C2 of the front portion 18A2 is inserted into a slot, such as slot 40A1 of FIG. 1 and slot 40A3 of FIG. 3 (described below). The rear portion 12A2 further has a coupling section 39A1. The coupling section 39A1 is used for coupling the second panel 100B to the first panel 100A as will be shown in FIG. 4, described below.

Like the first panel 100A of FIG. 1, the fold lines 33 of FIG. 2 define lines/sections where the second panel 100B is folded to form the three-dimensional volume/package/finished/completed product illustrated in FIG. 5 described in more detail below.

Similar to FIG. 1, FIG. 2 further illustrates the two angles A1, A2. However, unlike the first panel 100A of FIG. 1, the second panel 100B has two sets of angles A1, A2. The first pair of angles A1 are defined by sides 13 of the bottom portion 16A2 and two sides of the rear portion 12A2 of the second panel 100B. Similarly, the second set of angles A2 are defined by two sides 11 of the top portion 10A2 and two sides of the rear portion 12A2. These two sets of angles A1, A2 dictate the overall angle or position of the first panel 100A and third panel 100C relative to the second panel 100B as illustrated in FIG. 5 described below.

According to the exemplary embodiment illustrated in FIG. 2, the top portion 10A2 and the bottom portion 16A2 may comprise a trapezoidal shape. Specifically, the trapezoidal shape may comprise a isosceles trapezoidal shape. Other shapes for the top portion 10A2 and the bottom portion 16A2 are possible and are included within the scope of this disclosure. It is the trapezoidal shape of the top and bottom portions 10A2, 16A2 that dictate/control the amount of curvature provided by the completed system 101 illustrated in FIG. 5.

Figure 3:
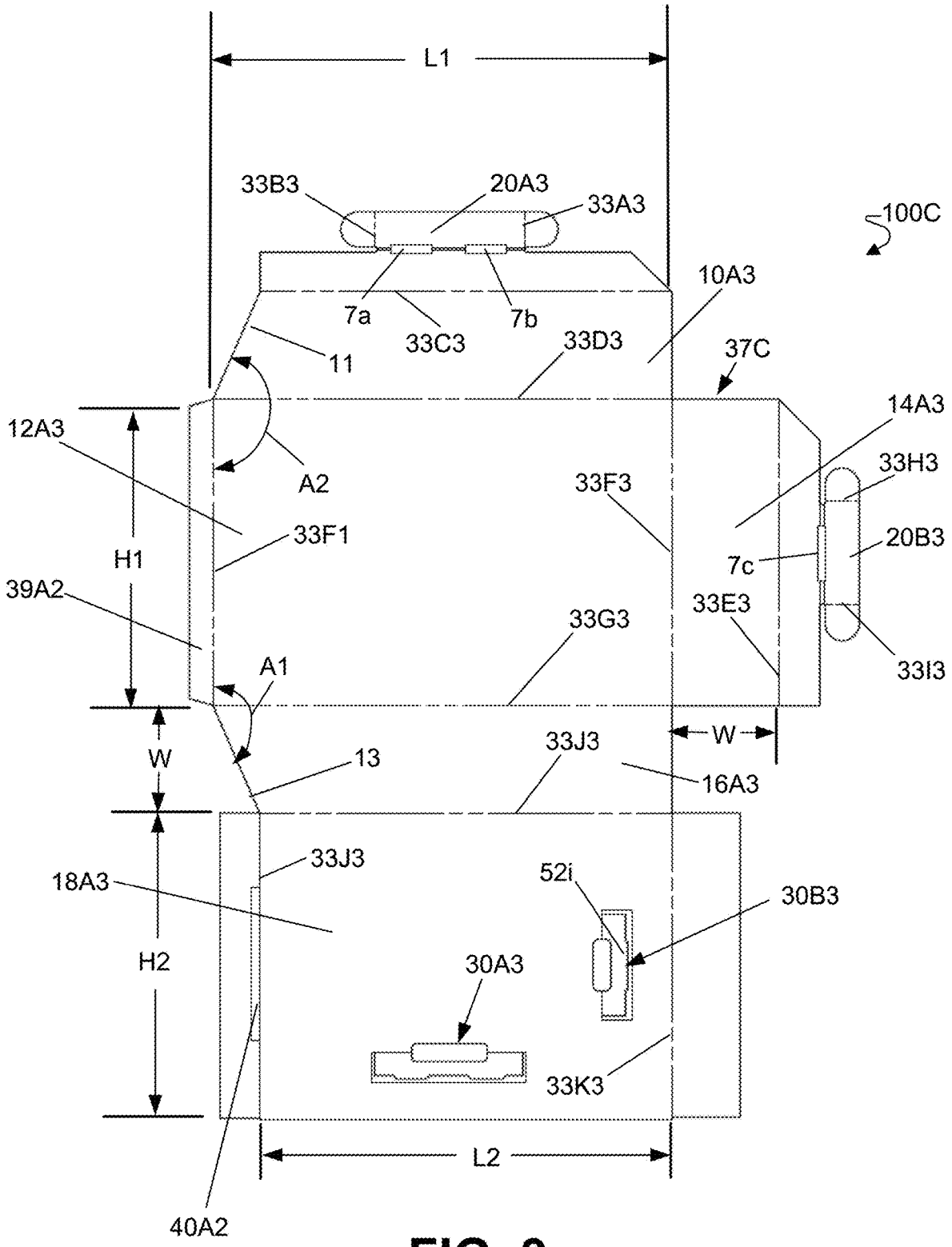
FIG. 3 illustrates a die-cut template for a third panel of three panels that may be applied to a substantially planar material like corrugated cardboard.

Referring now to FIG. 3, this figure illustrates a die-cut template for a third panel 100C of three panels that may be applied to a substantially planar material like corrugated cardboard. The third panel 100C is substantially similar or nearly identical to the first panel 100A of FIG. 1 except that the third panel 100C is a mirror image opposite relative to the first panel 100A of FIG. 1.

Like the first panel 100B, the third panel 100C of FIG. 3 may comprise a top portion 10A3, a rear portion 12A3, a side portion 14A3, a bottom portion 16A3, and a front portion 18A3. Like first panel 100A, the front portion 18A3 of the third panel 100C may further comprise a slot 40A2. Each of these portions 10A3, 12A3, 14A3, 16A3, and 18A3 may be defined by a combination of edge 37C and fold lines 33. Fold lines 33 define lines where the third panel 100C is folded to form the three-dimensional volume/package/finished/completed product illustrated in FIG. 5 described in more detail below.

Specifically, and as an example, the top portion 10A3 of the third panel 100C may be defined by the edge 37C, a fold line 33D3, and a fold line 33C3. Similarly, the rear portion 12A3 may be defined by edge 37C, a fold line 33G3, a fold line 33F3, and the fold line 33D3. The remaining three portions 14A3, 16A3, and 18A3 of panel 100C are defined similar to the top portion 10A3 and rear portion 12Ae described above and as shown in FIG. 3.

As noted above, the third panel 100C is a mirror image opposite of the exemplary embodiment illustrated in FIG. 1. And like the second panel 100B, the third panel 100C the rear portion 12A3 further has a coupling section 39A2. The coupling section 39A2 is used for coupling the third panel 100C to the second panel 100B as will be shown in FIG. 4, described below.

Also illustrated in FIG. 3 are two angles A1, A2 similar to FIG. 1. Angle A1 is defined by a side 13 of the bottom portion 16A3 and a side of the rear portion 12A3 of the third panel 100C. Similarly, the second angle A2 is defined by a side 11 of the top portion 10A3 and a side of the rear portion 12A3. These two angles A1, A2 dictate the overall angle or position of the second panel 100B relative to the third panel 100C as illustrated in FIG. 5 described below.

And like FIG. 1, according to the exemplary embodiment illustrated in FIG. 3, the top portion 10A3 and the bottom portion 16A3 may comprise a trapezoidal shape. Specifically, the trapezoidal shape for 10A3, 16A3 may comprise a right trapezoidal shape. Other shapes for the top portion 10A3 and the bottom portion 16A3 are possible and are included within the scope of this disclosure. It is the trapezoidal shape of the top and bottom portions 10A3, 16A3 that dictate/control the amount of curvature provided by the completed system 101 illustrated in FIG. 5.

Also illustrated in FIG. 3 are exemplary dimensions for a length (L), width (W), and a height (H) of the structures shown. The dimensions for the exemplary embodiment illustrated in FIG. 3 may comprise the following: length (L1) may have a magnitude of about 39.6 inches; length (L2) may have a magnitude of about 36.0 inches; height (H1) may have a magnitude of about 26.6 inches; height (H2) may have a magnitude of about 26.6 inches; and width (W) may have a magnitude of about 9.25 inches. However, other dimensions, smaller or greater, are possible and are within the scope of this disclosure. The dimensions shown in FIG. 3 are readily translated and correspond to the structures illustrated in FIGS. 1-2 as understood by one of ordinary skill in the art.

Figure 4:
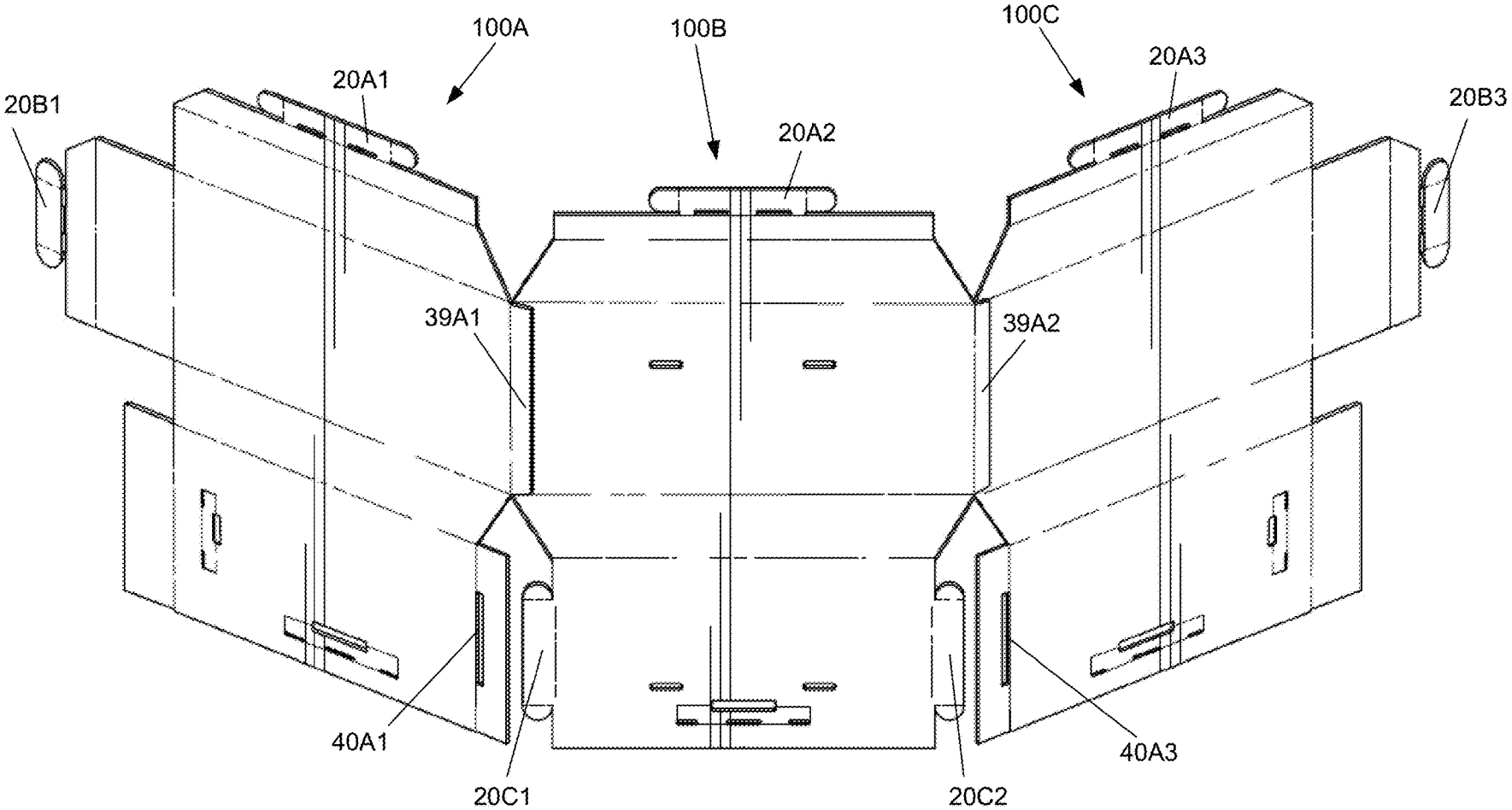
FIG. 4 illustrates how the three panels from FIGS. 1-3 may be coupled to together as an intermediate product, before each respective panel is folded along each of its fold lines to form the finished system/product of FIG. 5.

Referring now to FIG. 4, this figure illustrates how the three panels 100A-100C from FIGS. 1-3 may be coupled to together as an intermediate product, before each respective panel is folded along each of its fold lines to form the finished system/product 101 of FIG. 5. In FIG. 4, the first panel 100A is coupled to the second panel 100B along coupling section 39A1. Similarly, the third panel 100C is coupled to the second panel 100B along coupling section 39A2.

According to one exemplary embodiment, an adhesive such as glue may be applied to each coupling section 39 so that the panels 100A-C are joined together along the coupling sections 39. Other coupling devices, besides an adhesive, are possible and are included within the scope of this disclosure. Other coupling devices may include, but are not limited to, staples, tacks, rivets, screws, nails, etc.

Referring now to FIG. 5, this figure illustrates a perspective view of the finished system/product 101 formed from the three panels 100A-100C of FIGS. 1-4. In this view, the three front portions 18A1-A3, three top portions 10A1-A3 from the three panels 100A-100C and the single side portion 14A1 from the first panel 100A are visible. The system 101 may encapsulate or envelope a curved product 600 (not visible, but see FIG. 6).

Each panel 100 is positioned at an angle relative to another panel 100 in the finished system 101 illustrated in FIG. 5. Specifically, the first panel 100A is positioned at an angle A3 relative to the second panel 100B. This angle A3 is usually an obtuse angle. Similarly, the third panel is positioned at an angle A4 relative to the second panel 100B. This angle A4 is also usually an obtuse angle (i.e. an angle greater than ninety degrees as understood by one of ordinary skill in the art). These two angles A3, A4 of FIG. 5 are generally a function of the angles A1, A2 that exist between the bottom portion 18 and the rear portion 12, and between the top portion 10 and rear portion 12 described previously for each panel 100.

Figure 6:
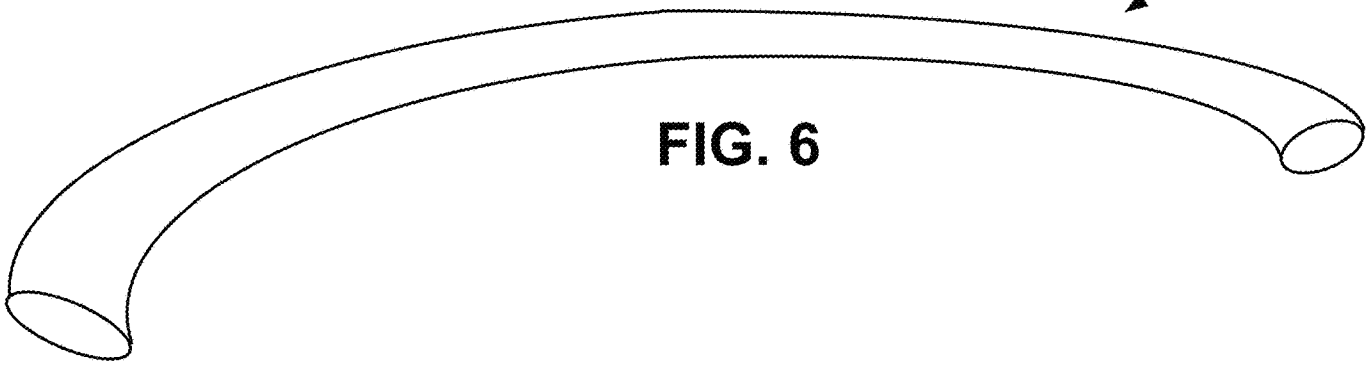
FIG. 6 illustrates an exemplary curved product that may be contained or positioned/shipped within the finished system shown in FIG. 5.

Referring now to FIG. 6, this figure illustrates an exemplary curved product 600 that may be contained or positioned/shipped within the finished system 101 shown in FIG. 5. According to one exemplary embodiment, the curved product 600 may comprise a bumper of a vehicle, such as an automobile. However, other products 600 are possible and are included within the scope of this disclosure. Also, while curved products 600 may be used with the system 100, it is possible to ship products 600 which are not curved and which may be straight. Further, products 600 shorter and/or substantially smaller may be shipped with the system 100 without departing from the scope and spirit of this disclosure. For example, system 100 may be desirable when a storage facility and/or shipping container (i.e. a bed/cargo area of a truck, train, plane etc.) may require a curved box for transporting goods which may or may not be curved themselves.

Figure 7:
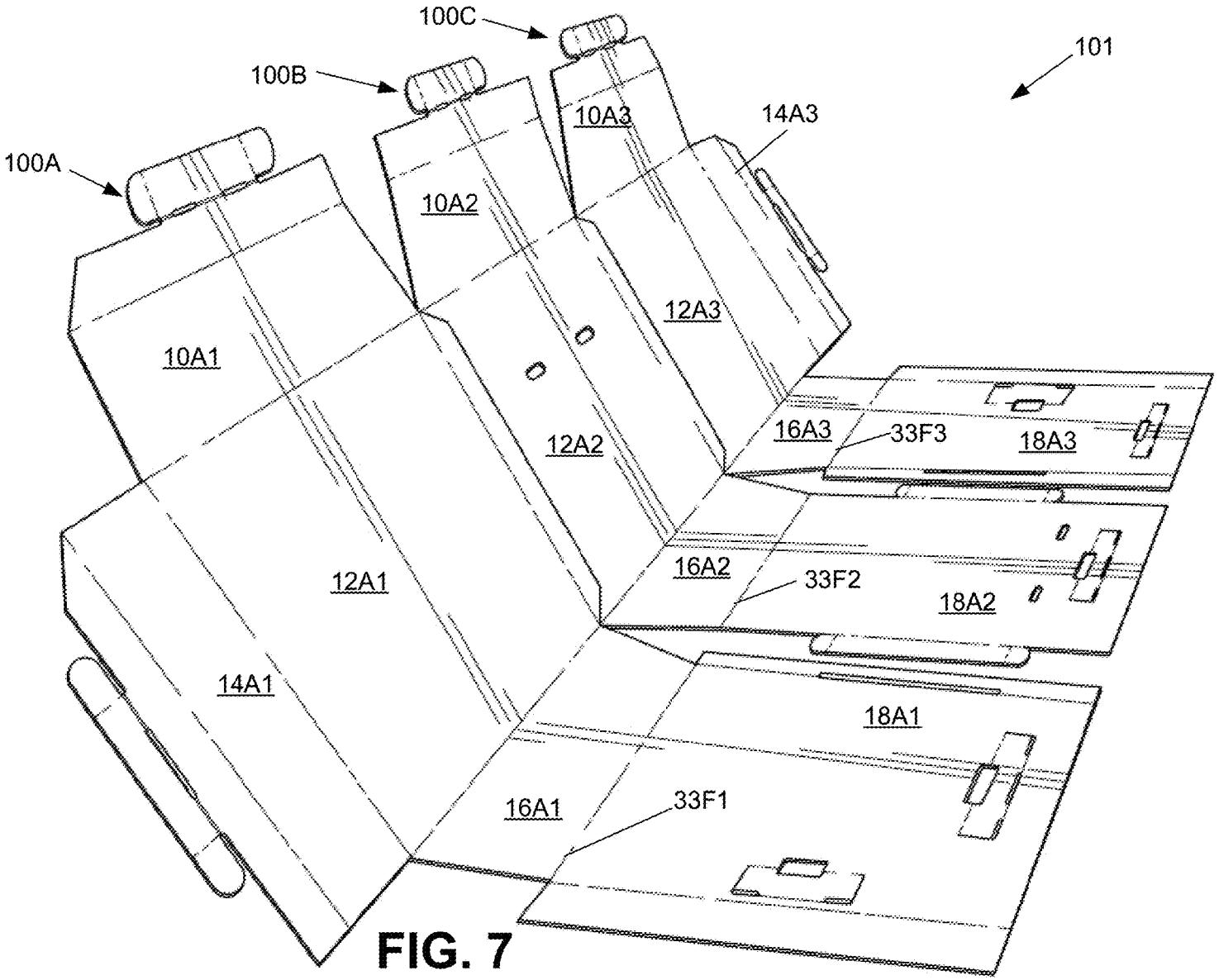
FIG. 7 illustrates an exemplary first step in forming the finished structure 101 that is illustrated in FIG. 5.

Referring now to FIG. 7, this figure illustrates an exemplary first step in forming the finished structure 101 that is illustrated in FIG. 5. It is noted that there is not just one method or one specific sequence of steps for forming the finished structure/system 101 shown in FIG. 5. There are multiple ways/sequences of steps that can be followed to form the finished structure 101 illustrated in FIG. 5. However, at least one method/specific sequence of steps will be described herein and are illustrated in FIGS. 7-24. Relative to FIG. 4, in FIG. 7, the three connected panels 100A-100C are laid out in a straight manner and folded along fold lines 33F1-33F3, such that the rear portions 12A1-12A3 are positioned at an angle relative to the front portions 18A1-18A3.

Figure 8:
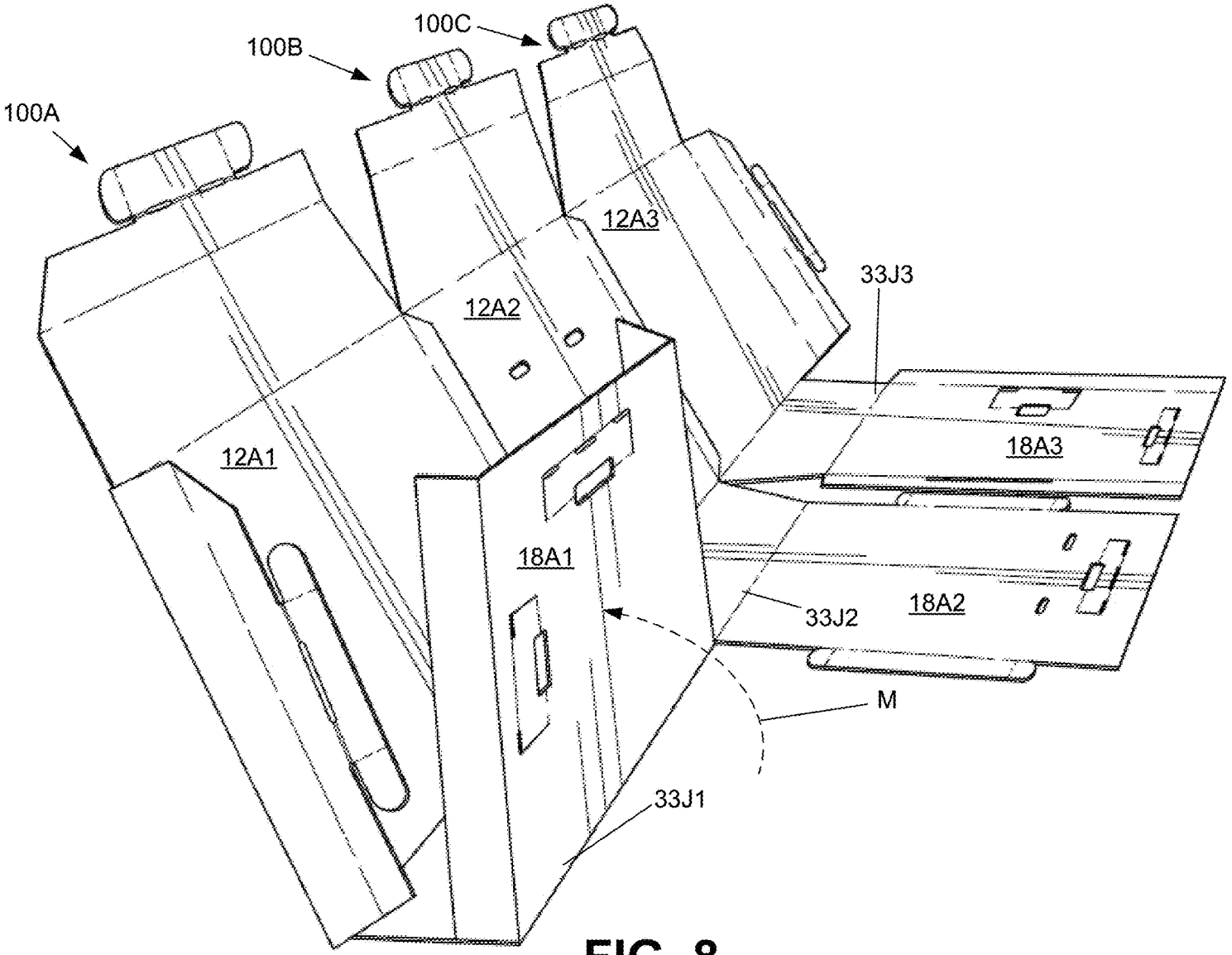
FIG. 8 illustrates how a front portion of the first panel is folded along fold line according to a directional arrow M towards the rear portion of the first panel.

Referring now to FIG. 8, this figure illustrates how a front portion 18A1 of the first panel 100A is folded along fold line 33J1 according to a directional arrow M towards the rear portion 12A1 of the first panel 100A. Referring now to FIG. 9, this figure illustrates how the second tab 20B1 that is coupled to the side portion 14A1 of the first panel 100A is mated and pushed through a second cut-out aperture 30B1 of the front portion 12A1 of the first panel 100A. The two ends of the second tab 20B1 are folded inwards towards a center of the second tab 201B1 along fold lines 33H1 & 3311 (see also FIG. 1). After the two ends of the second tab 20B1 are folded, then the second tab 20B1 may be pushed through cut-out aperture 30B1.

Referring now to FIG. 10, relative to FIG. 9, this figure illustrates how the second tab 20B1 is continued to be pushed through a second cut-out aperture 30B1 of the front portion 12A1 of the first panel 100A along movement arrow M. The ends of second tab 20B1 are not visible in this FIG. 10 since they have been folded and pushed through the cut-out aperture 30B1.

Figure 11:
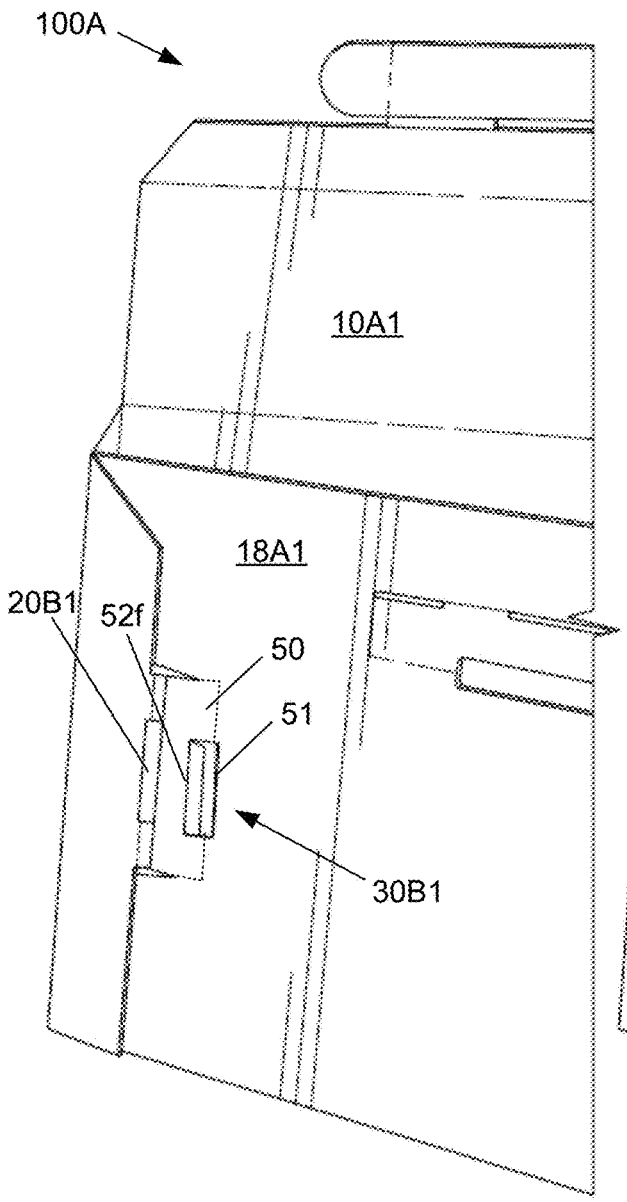
FIG. 11 illustrates how the second tab is further inserted into the second aperture of the front portion of the first panel.
Figure 12:
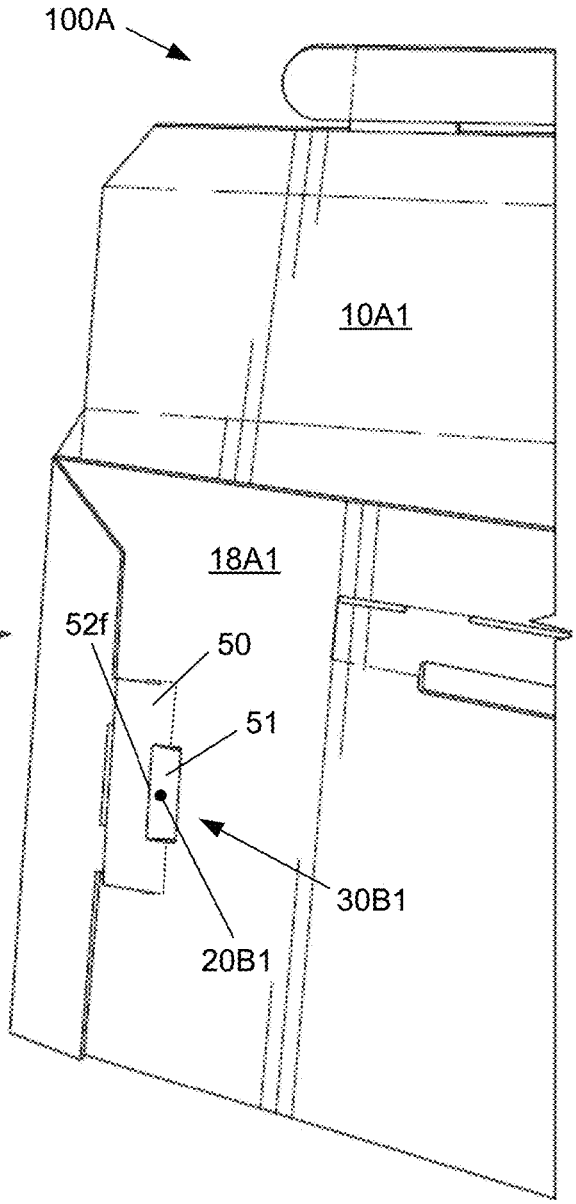
FIG. 12 illustrates how the second tab relative to FIG. 11 has moved more towards the central opening of the cut out aperture 30B1 and is now in its final "locked" position.

Referring now to FIG. 11, this figure shows how the second tab 20B1 is further inserted into the second cut-out aperture 30B1 of the front portion 12A1 of the first panel 100A. As shown in this view, the central flap 50 is elevated and positioned above the second tab 20B1. The second tab 20B1 is moved towards the opening 51. Referring now to FIG. 12, this figure illustrates how the second tab 20B1 relative to FIG. 11 has moved more towards the central opening 51 of the cut-out aperture 30B1 and is now in its final "locked" position.

Figure 13:
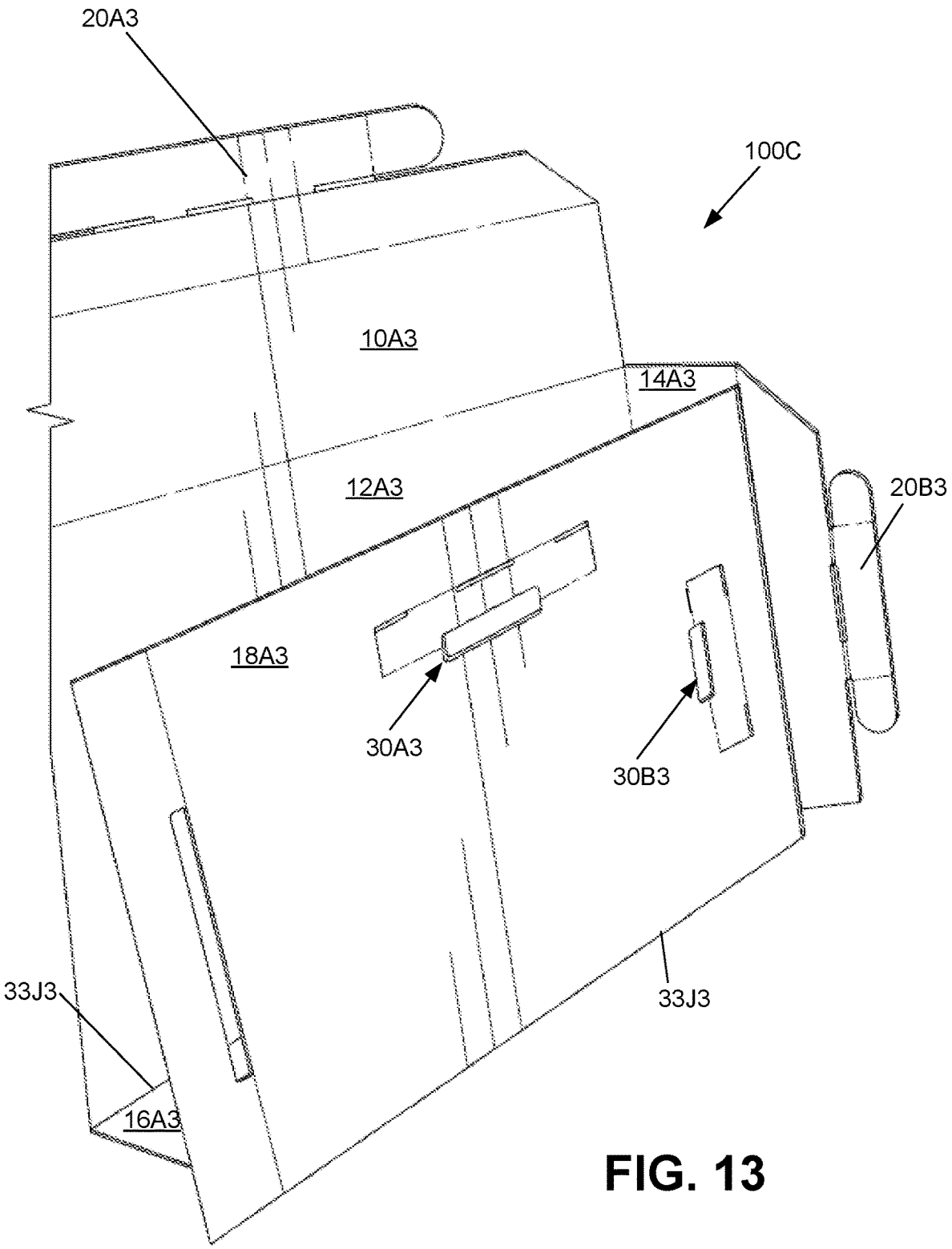
FIG. 13 illustrates how front portion of the third panel is folded along fold line such that the rear portion, bottom portion, and side portion are formed, while tab is prepared to be inserted into cut-out aperture of the front portion.
Figure 14:
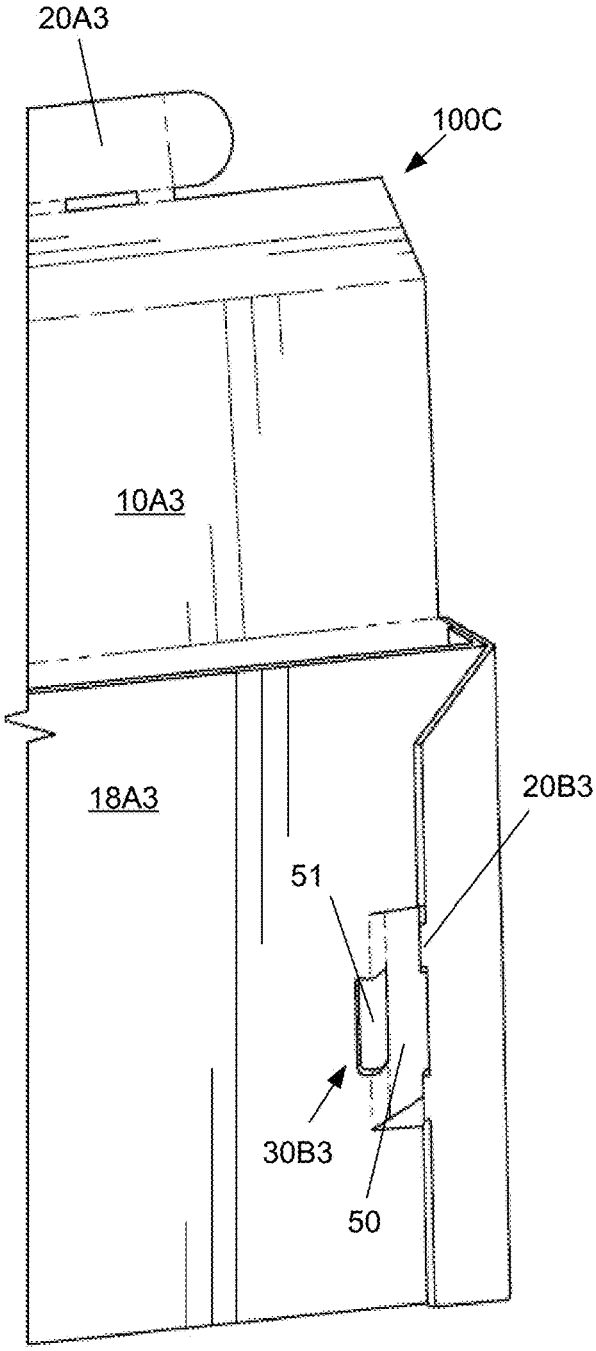
FIG. 14 illustrates a side view of the third panel from FIG. 13 after tab has been folded and inserted into the cut-out aperture 30B3.

Referring now to FIG. 13, this figure illustrates how front portion 18A3 of the third panel 100C is folded along fold line 33J3 such that the rear portion 12A3, bottom portion 16A3, and side portion 14A3 are formed, while tab 20B3 is prepared to be inserted into cut-out aperture 30B3 of the front portion 18A3. Referring now to FIG. 14, this figure illustrates a side view of the third panel 100C from FIG. 13 after tab 20B3 has been folded and inserted into the cut-out aperture 30B3. FIG. 14 demonstrates how the flap 50 is pulled above tab 20B3 to complete the coupling between tab 20B3 and the front portion 18A3.

Figure 15:
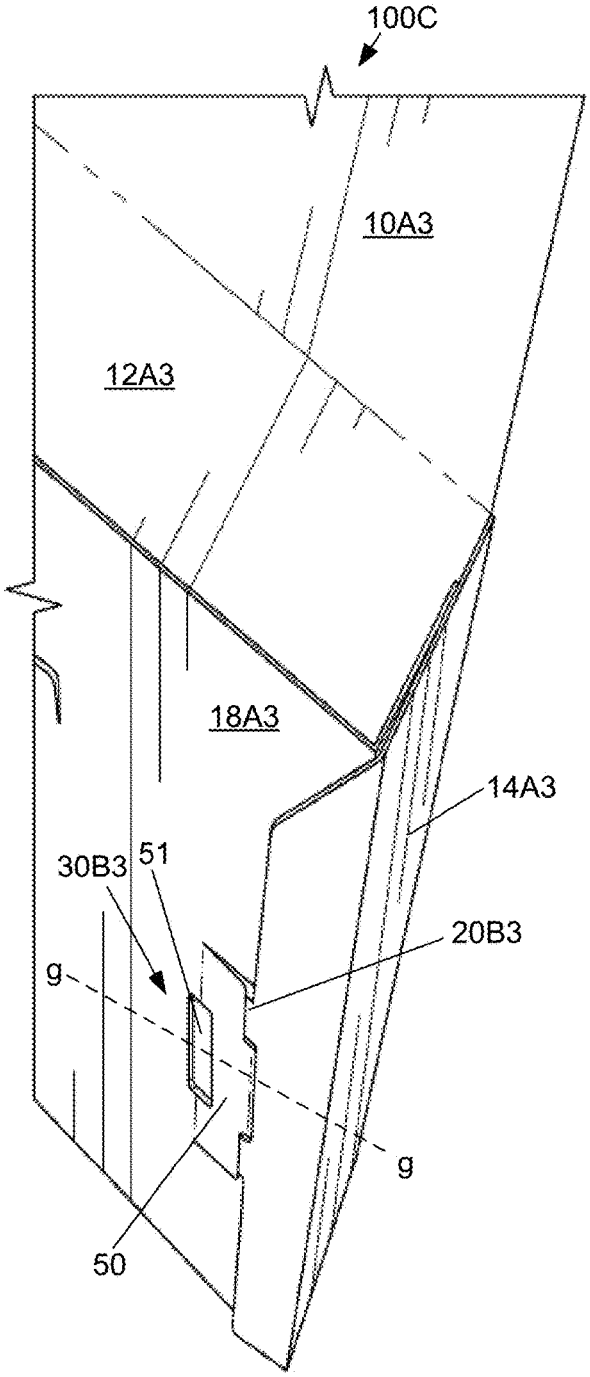
FIG. 15 illustrates a perspective view of the third panel 100C from FIG. 14 after the tab has been pushed through cut-out aperture and after the flap has been pulled above and over tab 20B3.

Referring now to FIG. 15, this figure illustrates a perspective view of the third panel 100C from FIG. 14 after tab 20B3 has been pushed through cut-out aperture and after flap 50 has been pulled above and over tab 20B3. In this view shown in FIG. 15, the front portion 18A3, the side portion 14A3, and rear portion 12A3 are clearly visible. The view of FIG. 15 shows how the front portion 18A3 is at ninety-degrees of the side portion 14A3, while the side portion 14A3 is also at ninety-degrees relative to the rear portion 12A3. Cut line g-g of FIG. 15 defines a cross-sectional view for FIG. 16G described below.

Figure 16A:
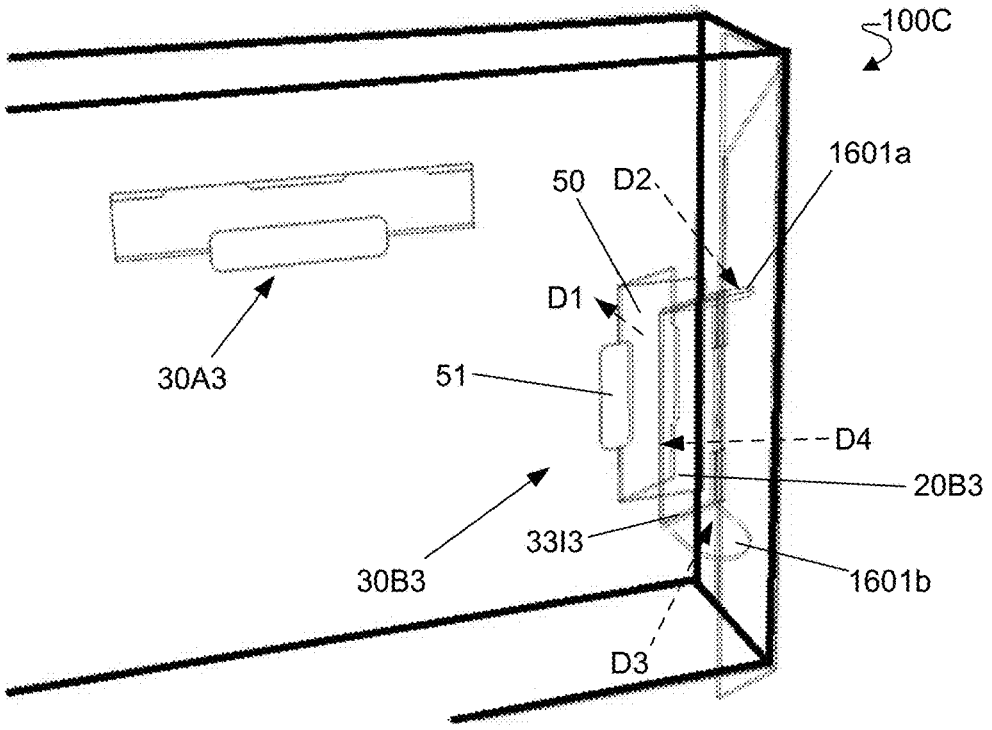
FIG. 16A is a perspective view illustrating a tab prior to being inserted into a cut-out aperture.

Referring now to FIGS. 16A-16F collectively, these figures are wire-frame perspective views that illustrate how a tab 20 is folded and pushed through the flap 50 of each cut-out aperture 30. Referring specifically now to FIG. 16A, this figure is a perspective view illustrating tab 20B3 prior to being inserted into cut-out aperture 30B3. In this FIG. 16A, tab 20B3 is folded along fold lines 33H3 (see FIG. 16B) and 3313 to form ear portions 1601*a*, 1601*b*. Ear portions 1601*a*, 1601*b* are moved in the directions shown by directional arrows D2, D3. Meanwhile, flap 51 of cut-out aperture 30B3 is moved along direction D1, while center of tab 20B3 is moved along direction D4.

Figure 16B:
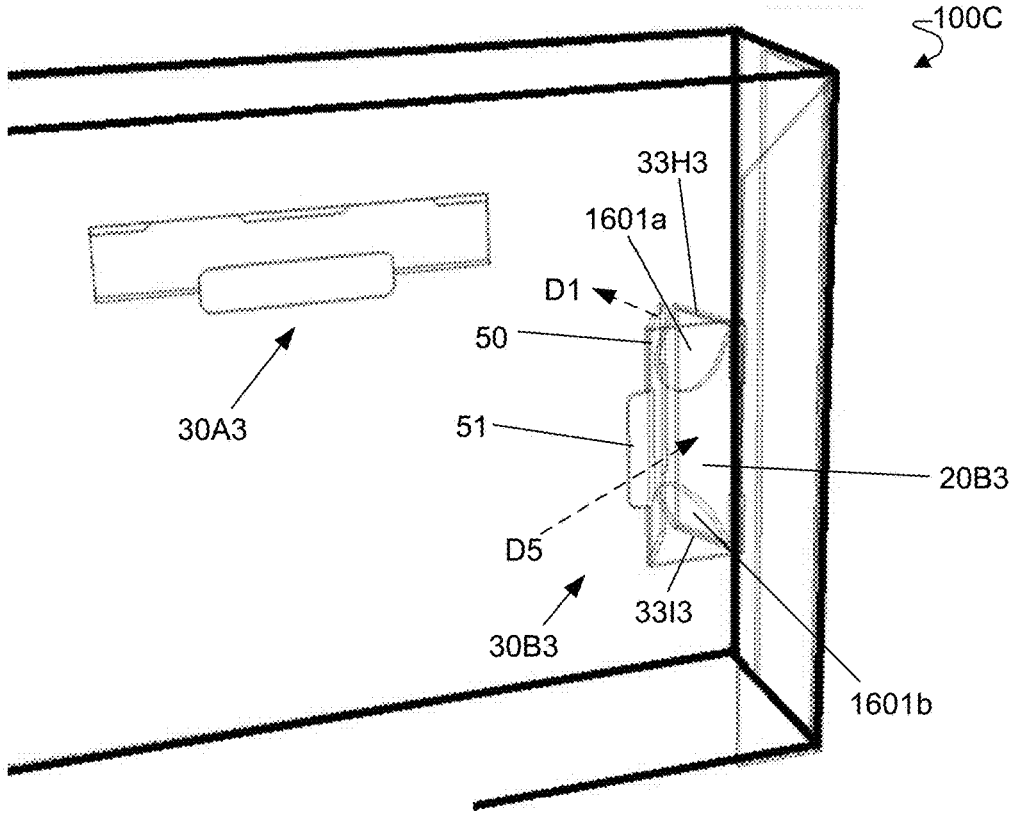
FIG. 16B is a perspective view illustrating the tab of FIG. 16A being inserted through cut-out aperture and after the movement shown in FIG. 16A.

Referring now to FIG. 16B, this figure is a perspective view illustrating tab 20B3 being inserted through cut-out aperture 20B3 and after the movement shown in FIG. 16A. In this FIG. 16B, flap 51 of cut-out aperture 30B3 continues to move along direction D1, while center of tab 20B3 with its folded ear portions 1601*a*, 1601*b* is moved along direction D5 and through the geometric plane defined by the cut-out aperture 30B3. In FIG. 16B, the fold line 33H3 for ear portion 1601*a* is readily visible compared to the view of FIG. 16A.

Figure 16C:
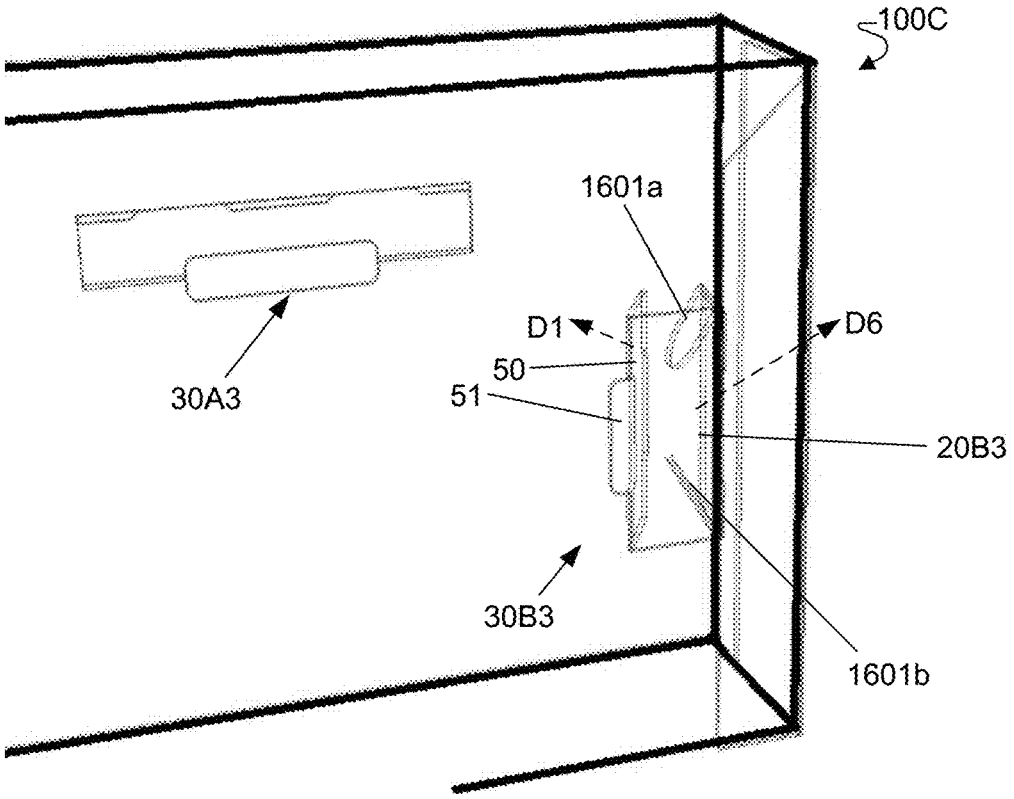
FIG. 16C is a perspective view illustrating the tab of FIG. 16B after it has been inserted into cut-out aperture and after the movement shown in FIG. 16B.

Referring now to FIG. 16C, this figure is a perspective view illustrating tab 20B3 of FIG. 16B after it has been inserted into cut-out aperture 30B3 and after the movement shown in FIG. 16B. In this view of FIG. 16C, flap 51 continues to move along direction D1 while tab 20B3 moves along direction D6.

Figure 16D:
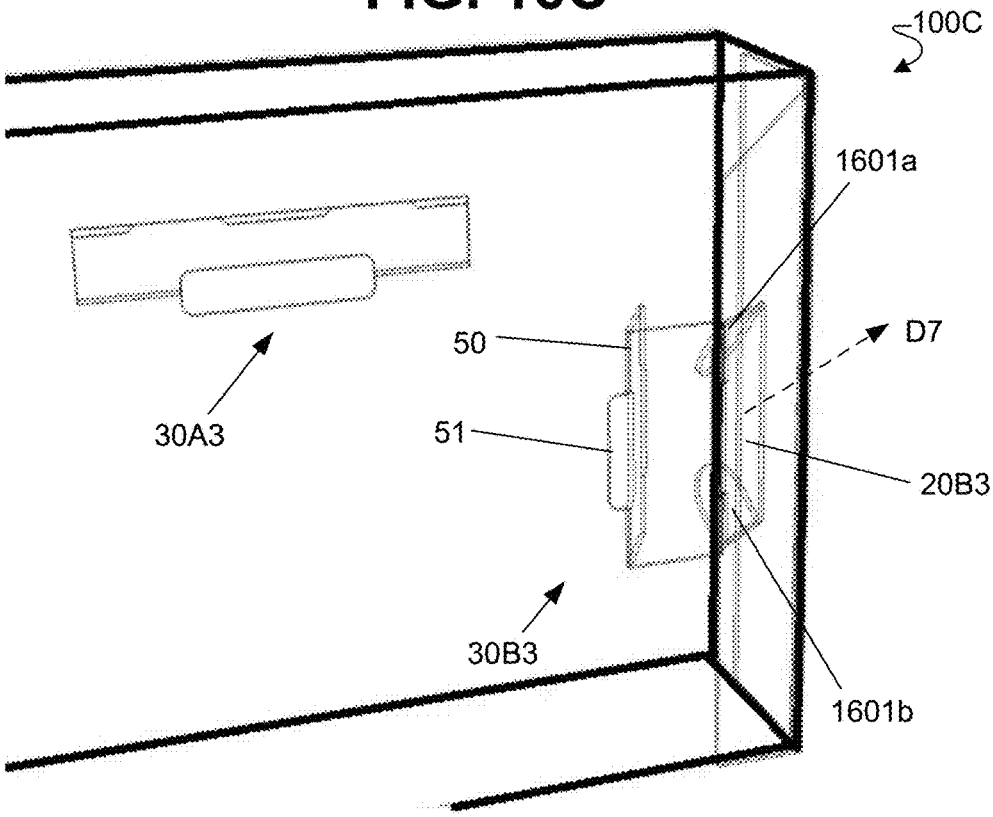
FIG. 16D is a perspective view illustrating the tab of FIG. 16C after it has been inserted into the cut-out aperture and after the movement shown in FIG. 16C.

Referring now to FIG. 16D, this figure is a perspective view illustrating tab 20B3 of FIG. 16C after it has been inserted into cut-out aperture 30B3 and after the movement shown in FIG. 16C. In this view, the tab 20B3 continues moving along direction D7. As shown in FIGS. 16A-16D, the tab 20B3 is rotating around an axis defined by its rectangular aperture 7*c* (not visible in FIG. 16, but see FIG. 3).

Figure 16E:
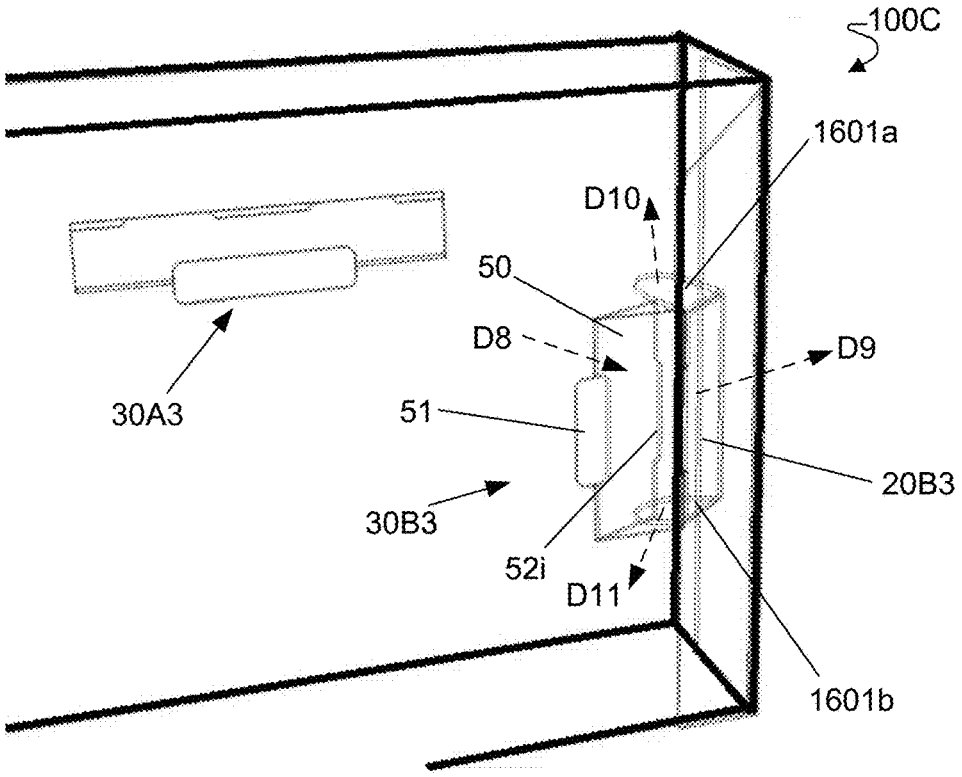
FIG. 16E is a perspective view illustrating the tab of FIG. 16D after it has been inserted into cut-out aperture and after the movement shown in FIG. 16D.

Referring now to FIG. 16E, this figure is a perspective view illustrating tab 20B3 of FIG. 16D after it has been inserted into cut-out aperture 30B3 and after the movement shown in FIG. 16D. In FIG. 16E, the flap 51 now moves along direction D8 (which is opposite to direction D1 of FIGS. 16A-16C). Meanwhile, the tab 20B3 continues to move along direction D6, while ear portions 1601*a*, 1601*b* move along directions D10, D11 (which are opposite to directions D2, D3 of FIG. 16A). This means the ear portions 1601*a*, 1601*b* are "opening" or "extending" relative to their folded positions illustrated in FIG. 16A.

Figure 16F:
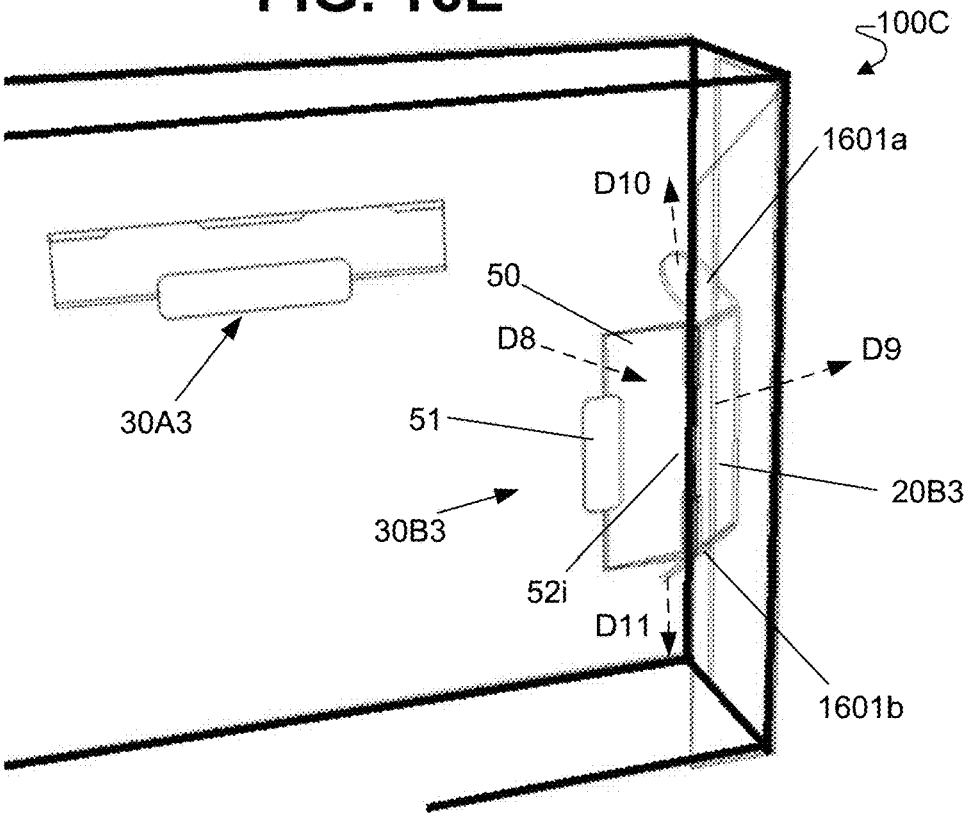
FIG. 16F, this figure is a perspective view illustrating tab 20B3 of FIG. 16E after it has been inserted into cut-out aperture 30B3 and after the movement shown in FIG. 16E.

Referring now to FIG. 16F, this figure is a perspective view illustrating tab 20B3 of FIG. 16E after it has been inserted into cut-out aperture 30B3 and after the movement shown in FIG. 16E. In FIG. 16F, ear portions 1601*a*, 1601*b* continue to move along directions D10, D11 so that the ear portions 1601*a*, 1601*b* are more "open" or "extended" relative to FIGS. 16A-E. The tab 20B3 continues to move along direction arrow D9, while flap 51 of cut-out aperture 30B3 continues to move along direction D8 which means flap 51 is entering a more "closed" position relative to FIGS. 16A-16E.

Figure 16G:
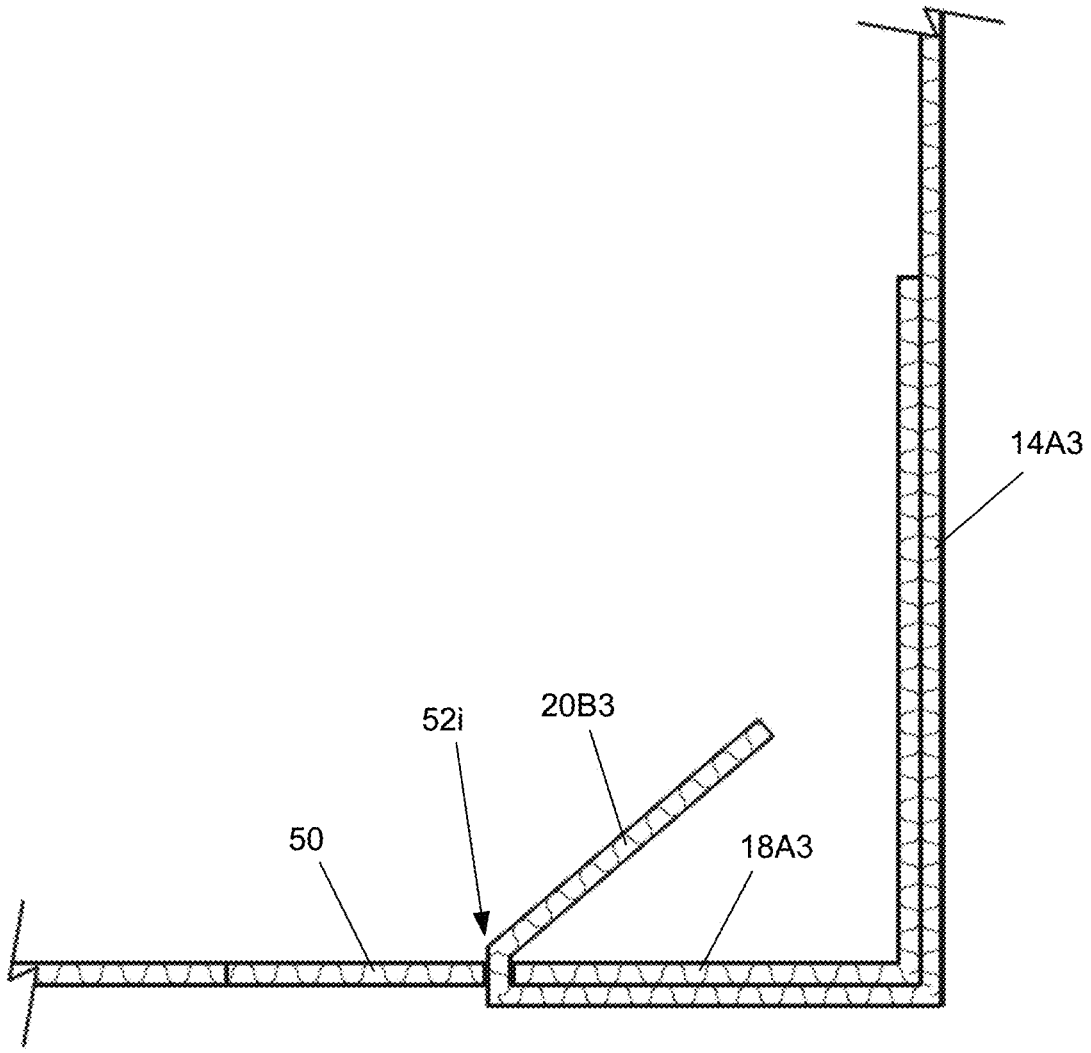
FIG. 16G illustrates a cross-sectional view taken along the cut-line g-g of FIG. 15.

Referring now to FIG. 16G, this figure illustrates a cross-sectional view taken along the cut-line g-g of FIG. 15, described previously. In this cross-section view, the flap 50 is shown in its completely "closed" position where mini-tab 52*i* (see also FIG. 3) has engaged with rectangular opening 7*c* (see also FIG. 3). The tab 20B3 remains in this fixed position shown in FIG. 16G where the side portion 14A3 is now "locked" or "fixed" in position relative to the front portion 18A3.

Figure 17:
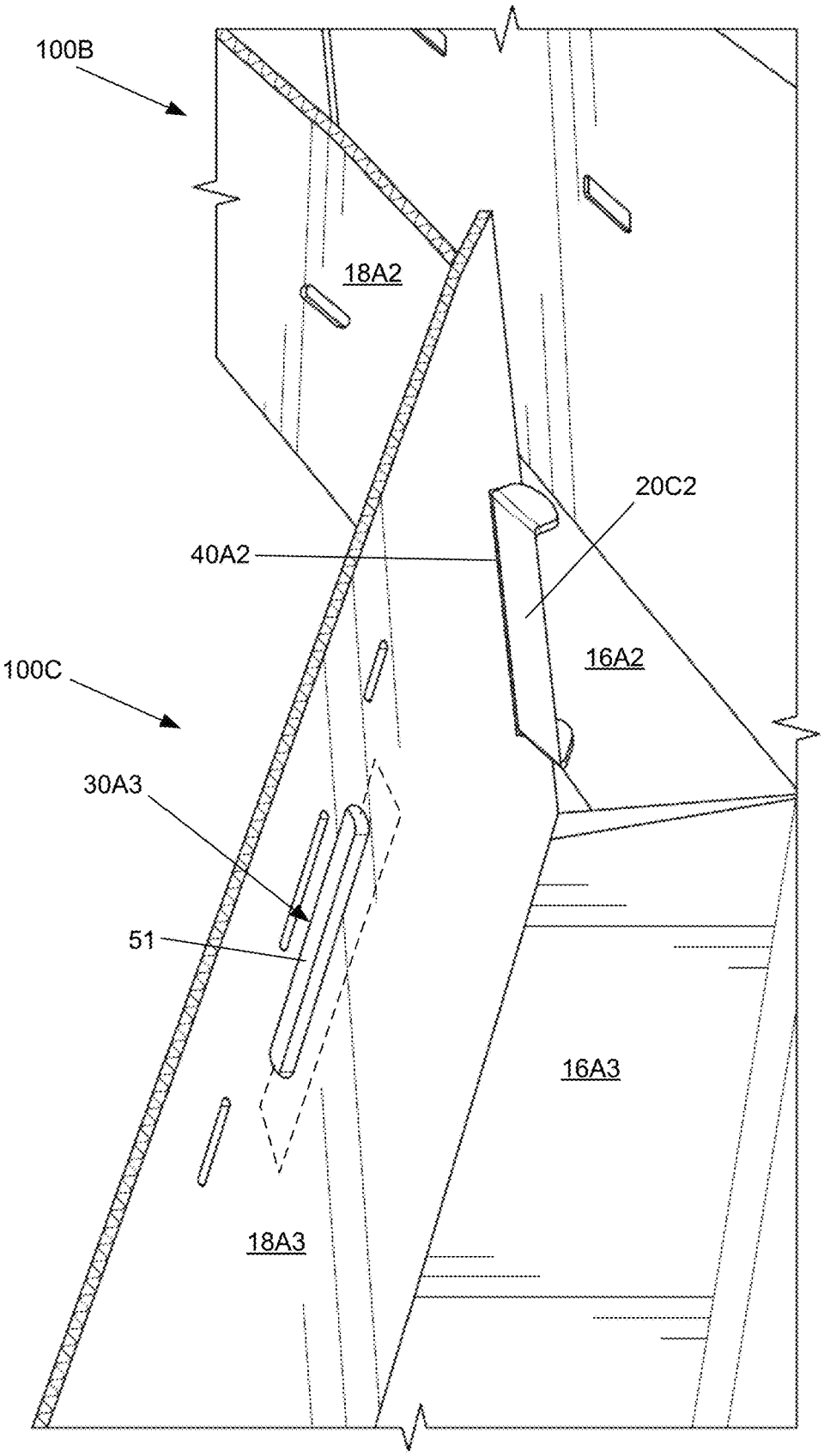
FIG. 17 illustrates a top perspective view of how the second panel and third panel may be coupled together along the slot of the third panel and the tab of the second panel.

Referring now to FIG. 17, this figure illustrates a top perspective view of how the second panel 100B and third panel may be coupled together along the slot 40A2 of the third panel and the tab 20C2 of the second panel. Specifically, the tab 20C2 of the front portion 18A2 of the second panel 100B may be folded and inserted into the slot 40A2 which is present in the front portion 18A3 of the third panel 100C. In this view of FIG. 17, the bottom portion 16A3 of the third panel 100C is clearly visible along with the bottom portion 16A2 of the second panel 100B.

Usually, one of the side panels, either the first panel 100A or the third panel 100C is partially assembled such that a respective side portion 14 is coupled to a respective front portion 18. Specifically, take the third panel 100C of FIG. 16 as an example: its side portion 14A3 is coupled to the front portion 18A3 using the tab 20B3 inserted into the cut-out aperture 30B3.

Once this coupling between the front portion 18A3 and side portion 14A3 is completed using the tab 20B3, then the front portion 18A3 of the third panel 100C may be coupled to the front portion 18A2 of the second panel 100B using the tab 20C2 and slot 40A2 as illustrated in FIG. 17. Alternatively, prior to the coupling of the third panel 100C to the second panel 100B using the tab 20C2 and slot 40A2, the tab 20C1 of the second panel 100B may be coupled to the front portion 18A1 of a partially assembled first panel 100A using the slot 40A1 (see FIG. 1). The coupling of the first panel 100A and the second panel 100B is illustrated in FIG. 18 described below.

Figure 18:
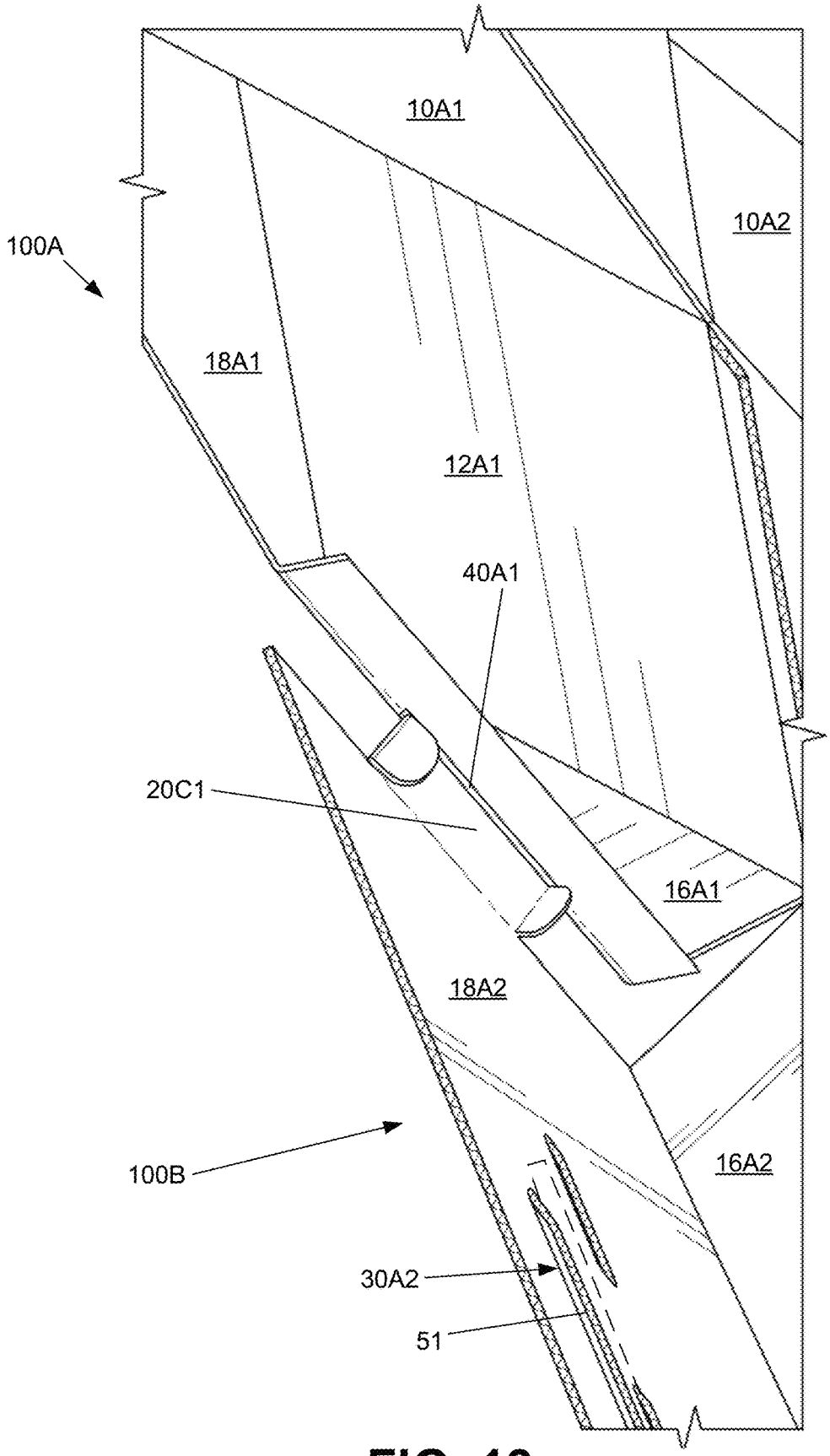
FIG. 18 illustrates how the first panel is coupled to the second panel using a tab of the second panel which is inserted into the slot of the front section of the first panel.

Referring now to FIG. 18, this figure illustrates how the first panel 100A is coupled to the second panel 100B using the tab 20C1 of the second panel 100B which is inserted into the slot 40A1 of the front section 18A1 of the first panel 100A. As noted previously, the tab 20C1 of the second panel 100B may be folded and then inserted through the slot 40A1 of the front portion 18A of the first panel 100A. This coupling between the first panel 100A and the second panel 100B can occur before or after the coupling between the second panel 100B and the third panel as illustrated in FIG. 17 described above.

Referring now to FIG. 19, this figure illustrates a top perspective view of the first panel before the top portion 10A1 is completely closed upon and completely coupled to the front portion 18A1 using the cut-out aperture 30A1. Specifically, FIG. 19 illustrates the tab 20A1 before it is folded and before it is inserted into the cut-out aperture 30A1 and behind the flap 50. FIG. 19 also shows the completed coupling between the side portion 14A1 (not visible in FIG. 19, but see FIGS. 11-12) and front portion 18A1 by the cut-out aperture 30B1.

Figure 20:
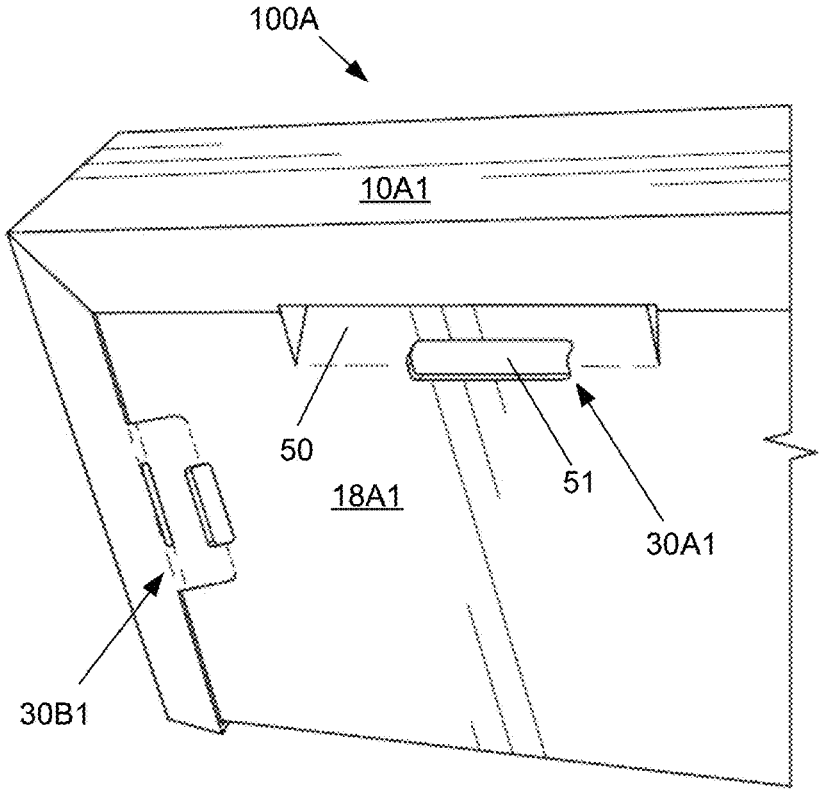
FIG. 20 illustrates the closing of the first panel by the top portion being coupled to the front portion of the first panel.

Referring now to FIG. 20, this figure illustrates the closing of the first panel 100A by the top portion 10A1 being coupled to the front portion 18A1 of the first panel 100A. The tab 20A1 (visible in FIG. 19) has been inserted into the cut-out aperture 30A1. As shown in FIG. 20, the flap 50 of the cut-out aperture 30A1 is being pulled above the tab 20A1.

Figure 21:
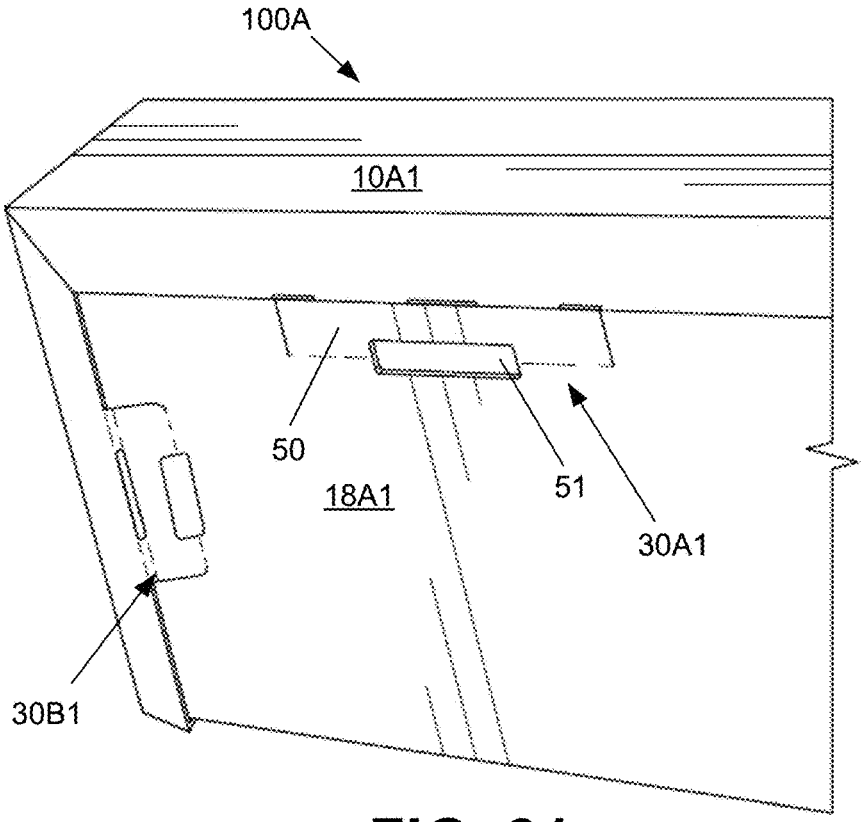
FIG. 21 illustrates the completed coupling of the top portion from FIG. 20 to the front portion of the first panel.

Referring now to FIG. 21, this figure illustrates the completed coupling of the top portion 10A1 from FIG. 20 to the front portion 18A1 of the first panel 100A. In FIG. 21, the front flap 50 of the cut-out aperture 30A1 has been completely elevated and positioned above the tab 20A1 (not visible in FIG. 21, but see FIG. 19).

Figure 22:
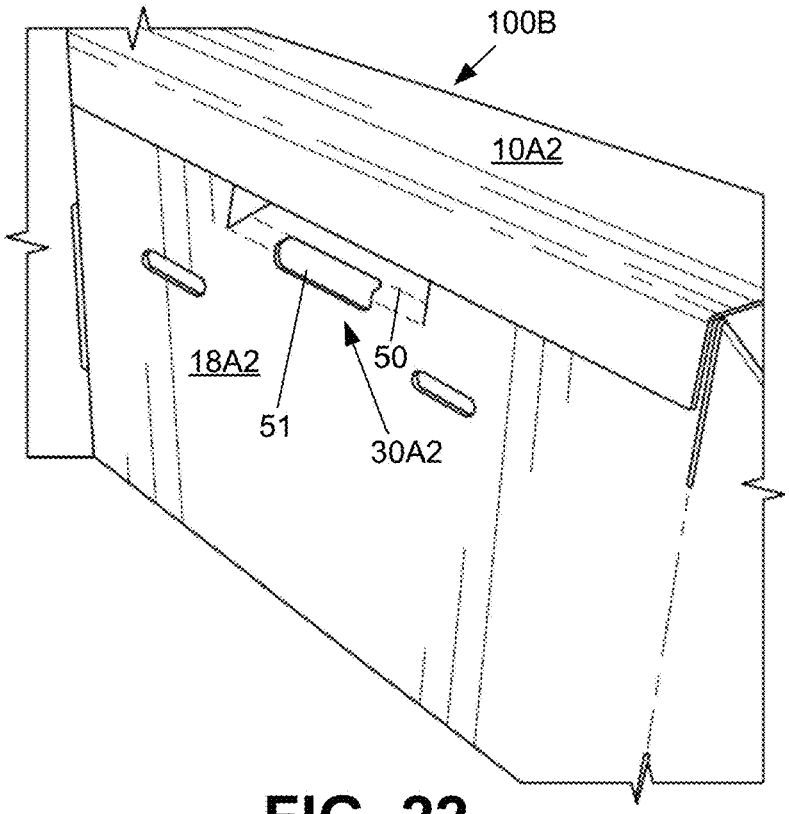
FIG. 22 illustrates the closing of the second panel by the top portion being coupled to the front portion of the second panel.

Referring now to FIG. 22, this figure is similar to FIG. 20 since it illustrates the closing of the second panel 100B by the top portion 10A2 being coupled to the front portion 18A2 of the second panel 100B. FIG. 22 shows how the flap 50 is elevated and placed above the tab 20A2 (not visible in FIG. 22, but see FIG. 2).

Figure 23:
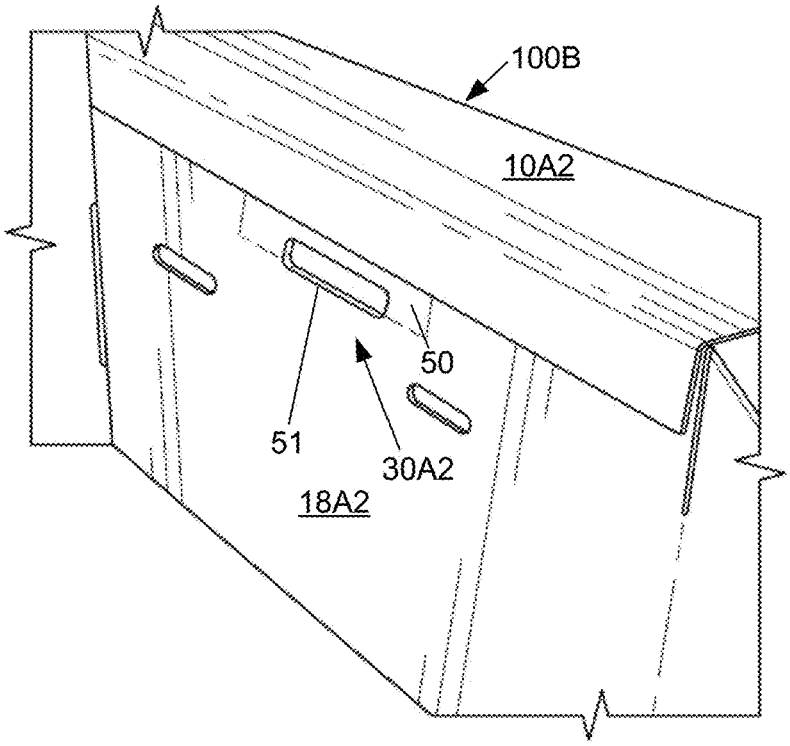
FIG. 23 is similar to FIG. 21 since it illustrates the completed coupling of the top portion from FIG. 22 to the front portion of the second panel.

Referring now to FIG. 23, this figure is similar to FIG. 21 since it illustrates the completed coupling of the top portion 10A2 from FIG. 22 to the front portion 18A2 of the second panel 100B. Like FIG. 21, in FIG. 23, the front flap 50 of the cut-out aperture 30A2 has been completely elevated and positioned above the tab 20A2 (not visible in FIG. 23, but see FIG. 2).

Figure 24:
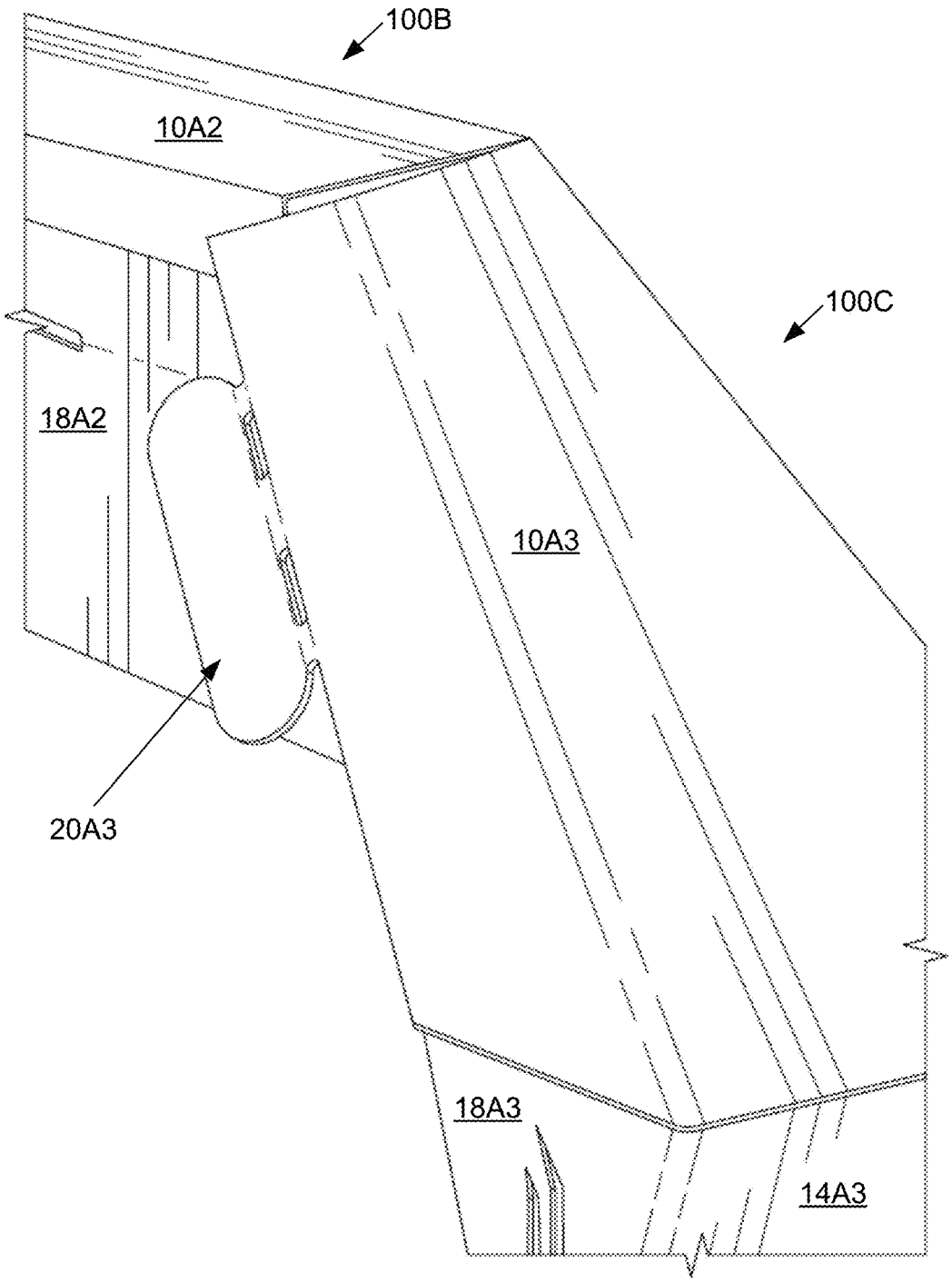
FIG. 24 is similar to FIG. 19 since it illustrates a top perspective view of the third panel before the top portion is completely closed upon and completely coupled to the front portion of the third panel using the cut-out aperture of the front portion.

FIG. 24 is similar to FIG. 19 since it illustrates a top perspective view of the third panel 100C before the top portion is completely closed upon and completely coupled to the front portion 18A3 of the third panel 100B using the cut-out aperture 20A3 (not visible, but see FIG. 25) of the front portion 18A3. Specifically, FIG. 24 illustrates the tab 20A3 before it is folded and before it is inserted into the cut-out aperture 30A3 and behind the flap 50 (not visible in FIG. 24, but see FIG. 25). FIG. 19 also shows the completed coupling between the top portion 10A2 of the second panel 100B with the front portion 18A2 of the second panel 100B.

Figure 25:
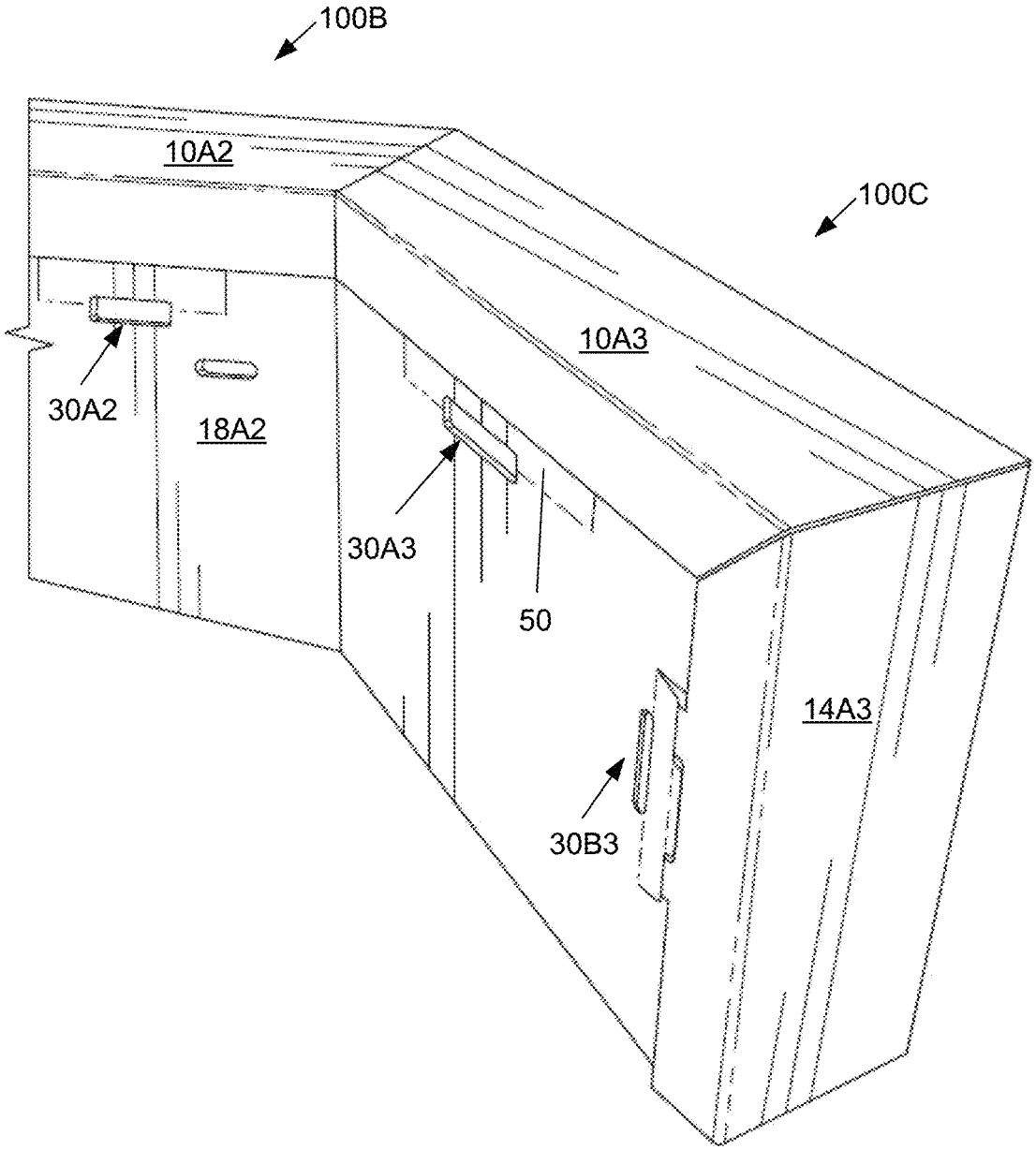
FIG. 25 is similar to FIG. 21 since it illustrates the completed coupling of the top portion from FIG. 24 to the front portion of the third panel.

Referring now to FIG. 25, this figure is similar to FIG. 21, since it illustrates the completed coupling of the top portion from FIG. 24 to the front portion of the third panel. In FIG. 25, the front flap 50 of the cut-out aperture 30A3 has been completely elevated and positioned above the tab 20A3 (not visible in FIG. 25, but see FIG. 24).

The present solution has been described using detailed descriptions of embodiments thereof that are provided by way of example and are not intended to limit the scope of the solution. The described embodiments comprise different features, not all of which are required in all embodiments of the solution. Some embodiments of the present solution utilize only some of the features or possible combinations of the features. Variations of embodiments of the present solution that are described and embodiments of the present solution comprising different combinations of features noted in the described embodiments will occur to persons of the art.

Figure 26:
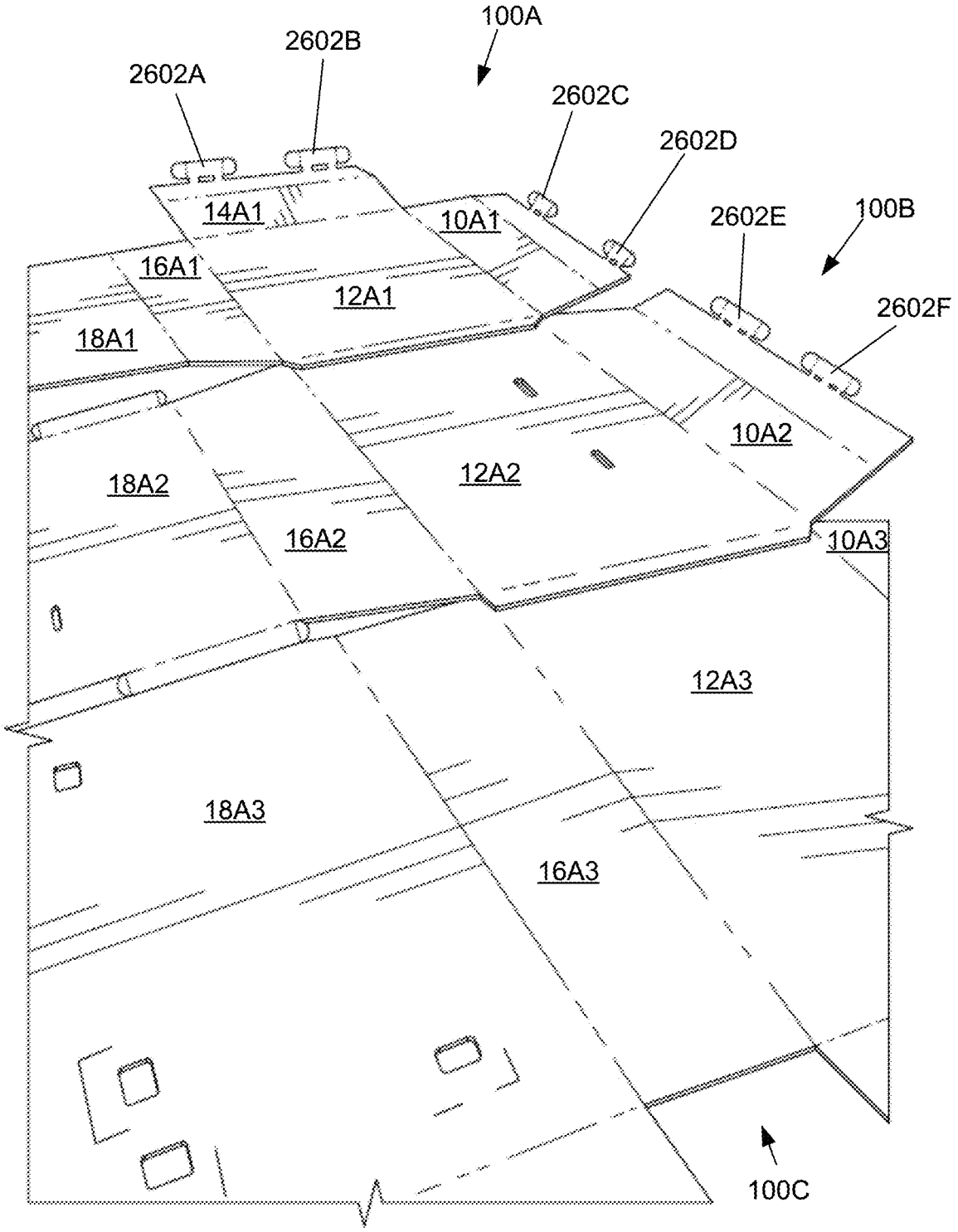
FIG. 26 illustrates an alternative exemplary embodiment where the single large tabs of FIGS. 1-25 have been replaced with two smaller tabs.

For example, referring now to FIG. 26, this figure illustrates an alternative exemplary embodiment where the single large tabs 20 of FIGS. 1-25 have been replaced with two smaller tabs 2602A-2602F. Each tab 2602 is provided with its own cut-out aperture 30, similar to the prior embodiments, but each cut-out aperture is made smaller to accommodate/mate with each respective smaller tab 2602 as understood by one of ordinary skill in the art.

Figure 27:
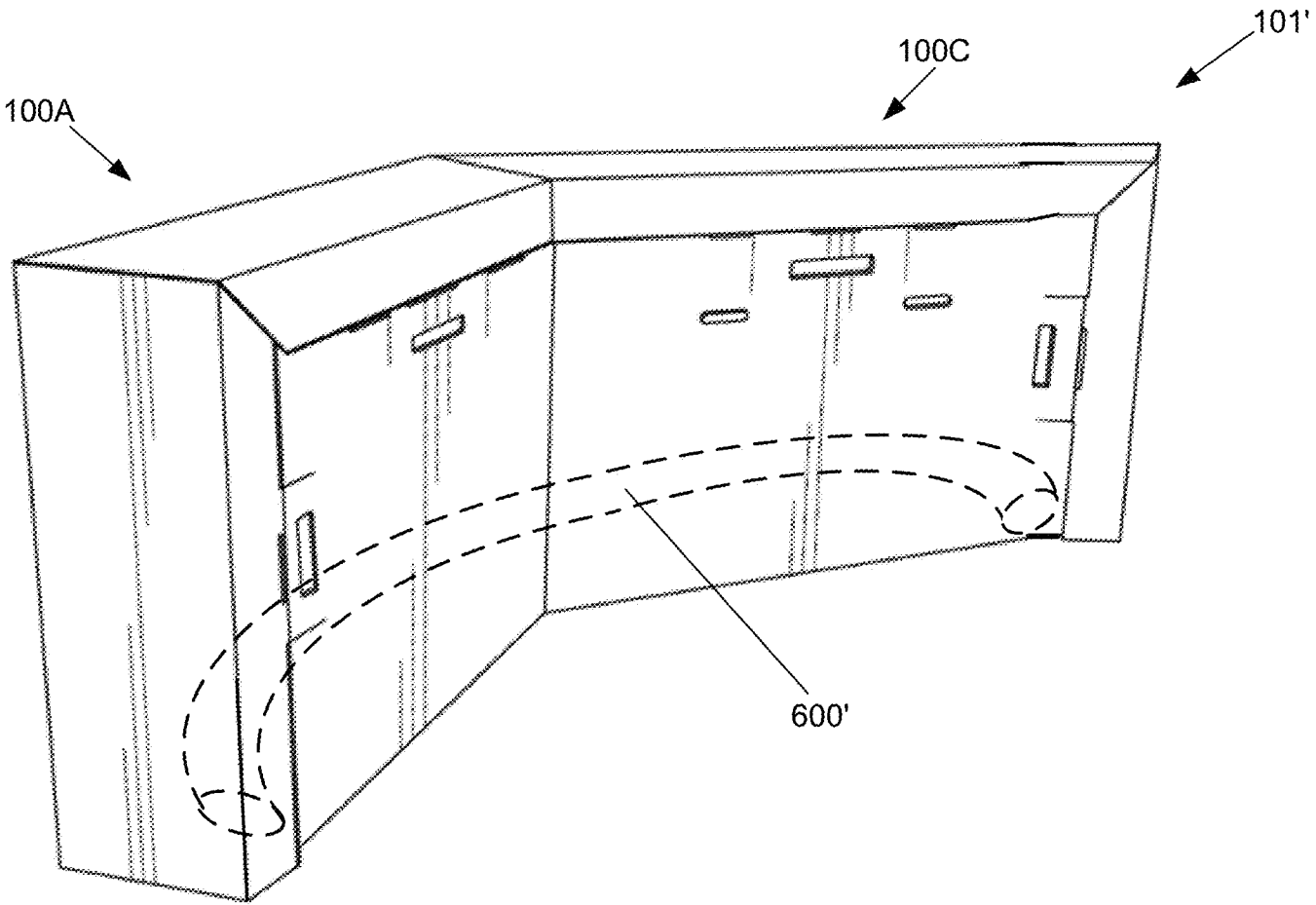
FIG. 27 illustrates an alternative exemplary embodiment of the system where the system is formed from two panels instead of three panels.

While only three panels 100A, 100B, and 100C have been illustrated in FIGS. 1-26, it is possible to form a completed packaging solution/system 101 shown in FIG. 5 by using additional or fewer panels 100. For example, referring now to FIG. 27, this figure illustrates an alternative exemplary embodiment of the system 101' where the system 101' is formed from two panels 100A, 100C instead of three panels (100A-100C). As described previously, the degree of curvature of an object 600 (see FIG. 6) that can be placed within the system 101 is a function of the number of panels 100 and the bottom portion angle A1 and the top portion angle A2 (See FIGS. 1-3) as understood by one of ordinary skill in the art. In FIG. 27, a curved object 600' is shown with dashed lines to indicate that it is hidden from view but positioned within the volume defined by the system 101'.

While one preferred material for the inventive system 101 is corrugated cardboard, other materials may be used without departing from the scope of this disclosure. Other materials may include, but are not limited to, plastics, metals, composite materials, thick paper, etc.

It will be appreciated by persons skilled in the art that the present invention is not limited by what has been particularly shown and described herein above. Rather the scope of the invention is defined by the claims that follow.

What is claimed is:

1. A system for enclosing curved objects, comprising:

a first panel comprising a first top portion, a first rear portion, a first side portion, a first bottom portion, and a first front portion, wherein each of the first bottom portion and first top portion is in the form of a right trapezoid;

a second panel comprising a second top portion, a second rear portion, a second bottom portion, and a second front portion, wherein each of the second bottom portion and second top portion is in the form of an isosceles trapezoid; and a third panel comprising a third top portion, a third rear portion, a second side portion, a third bottom portion, and a third front portion, wherein each of the third bottom portion and third top portion is in the form of a right trapezoid;

wherein the first panel being coupled to the second panel by at least a tab and a slot, the second panel being coupled to the third panel by at least a tab and a slot, and each top portion being coupled to a respective front portion by a tab and a cut-out aperture; and wherein the first, second, and third panels collectively define a single space configured to receive a curved object.

2. The system of claim 1, wherein each panel is positioned at an angle relative to a neighboring panel.

3. The system of claim 2, wherein the angle comprises an obtuse angle.

4. The system of claim 1, wherein each top portion is at a ninety-degree angle relative to a respective front portion.

5. The system of claim 1, wherein each side portion is at a ninety-degree angle relative to a respective front portion.

6. The system of claim 1, wherein each cut out-aperture comprises a flap that is positioned adjacent to a respective tab.

7. The system of claim 6, wherein each cut-out aperture further comprises an opening.

8. The system of claim 1, wherein a certain curved object is positioned within the volume defined by the panels.

* * * * *